US011111115B2

(12) United States Patent
Calaman et al.

(10) Patent No.: US 11,111,115 B2
(45) Date of Patent: Sep. 7, 2021

(54) WEAR PAD WITH INSERT FOR TELESCOPING BOOM ASSEMBLY

(71) Applicant: Manitowoc Crane Companies, LLC, Manitowoc, WI (US)

(72) Inventors: Bradley Charles Calaman, Carlisle, PA (US); John Fremont Benton, Smithsburg, MD (US)

(73) Assignee: Maniitowoc Crane Companies, LLC, Manitowoc, WI (US)

( * ) Notice: Subject to any disclaimer, the term of this patent is extended or adjusted under 35 U.S.C. 154(b) by 184 days.

(21) Appl. No.: 15/906,823

(22) Filed: Feb. 27, 2018

(65) Prior Publication Data

US 2018/0251348 A1 Sep. 6, 2018

Related U.S. Application Data

(60) Provisional application No. 62/466,101, filed on Mar. 2, 2017.

(51) Int. Cl.
*B66C 23/70* (2006.01)

(52) U.S. Cl.
CPC ..... *B66C 23/707* (2013.01); *B66C 23/701* (2013.01)

(58) Field of Classification Search
CPC ..... B66C 23/00; B66C 23/62; B66C 23/701; B66C 23/707
See application file for complete search history.

(56) References Cited

U.S. PATENT DOCUMENTS 2,936,907 A 5/1960 Wodruff
2,998,856 A 9/1961 Larsen
3,719,403 A 3/1973 Sung
3,809,249 A * 5/1974 Grove ..... B66C 23/701 212/349
3,985,234 A * 10/1976 Jouffray ..... B66C 23/707 212/350
4,004,695 A 1/1977 Hockensmith et al.
(Continued)

FOREIGN PATENT DOCUMENTS

CN 102398864 A 4/2012
CN 204622450 U 9/2015
(Continued)

OTHER PUBLICATIONS

JP-2008/265980 Machine Translation (Year: 2008).*
(Continued)

*Primary Examiner* — Michael R Mansen
*Assistant Examiner* — Juan J Campos, Jr.
(74) *Attorney, Agent, or Firm* — Klintworth & Rozenblat IP LLP

(57) ABSTRACT

A wear pad for a telescoping boom assembly includes a wear pad body having a first surface and a second surface oppositely positioned from the first surface and spaced from the first surface by a height of the wear pad body, a groove formed in one of the first surface and the second surface, the groove extending along a length of the wear pad body, and an insert positioned in the groove such that a portion of the insert projects outwardly from the groove. The telescoping boom assembly includes an inner boom section and an immediately adjacent outer boom section. The wear pad is configured to be installed between the inner and outer boom sections.

20 Claims, 18 Drawing Sheets

(56) References Cited

U.S. PATENT DOCUMENTS

| | | | | |
|---|---|---|---|---|
| 4,027,772 | A | 6/1977 | Garber | |
| 4,045,936 | A | 9/1977 | Sterner | |
| 4,102,094 | A | 7/1978 | MacKinnon | |
| 4,217,987 | A * | 8/1980 | Gattu | B66C 23/701 212/299 |
| 4,273,244 | A | 6/1981 | Jensen et al. | |
| 4,327,533 | A | 5/1982 | Sterner | |
| 4,383,792 | A | 5/1983 | Seabloom et al. | |
| 4,434,994 | A | 3/1984 | Pepin | |
| 4,662,527 | A | 5/1987 | Cuhel | |
| 4,688,689 | A | 8/1987 | Barsuhn | |
| 4,700,851 | A | 10/1987 | Reeve et al. | |
| 5,181,588 | A | 1/1993 | Emmons | |
| 5,240,129 | A | 8/1993 | Schrick et al. | |
| 5,427,256 | A | 6/1995 | Kleppe | |
| 5,484,069 | A | 1/1996 | Lanning | |
| 5,642,821 | A | 7/1997 | Hafliger | |
| 5,678,662 | A | 10/1997 | Giorgetti et al. | |
| 5,690,240 | A | 11/1997 | Thiermann, Sr. | |
| 5,725,112 | A | 3/1998 | Thorby | |
| 5,765,248 | A | 6/1998 | Ono | |
| 5,829,606 | A * | 11/1998 | Erdmann | B66C 23/707 212/350 |
| 5,865,328 | A * | 2/1999 | Kaspar | B66C 23/701 212/230 |
| 6,108,985 | A | 8/2000 | Paschke et al. | |
| 6,145,843 | A | 11/2000 | Hwang | |
| 6,164,669 | A * | 12/2000 | Svensson | A63C 17/06 280/11.221 |
| 6,216,895 | B1 | 4/2001 | Erdmann et al. | |
| 6,499,612 | B1 | 12/2002 | Harrgington et al. | |
| 6,702,132 | B1 | 3/2004 | Moore et al. | |
| 6,735,486 | B2 | 5/2004 | Hoffelmeyer et al. | |
| 6,871,710 | B1 | 3/2005 | Darling et al. | |
| 6,945,336 | B1 | 9/2005 | Darling et al. | |
| 7,044,315 | B2 | 5/2006 | Hans-Dieter | |
| 7,331,748 | B2 | 2/2008 | Knepp et al. | |
| 7,472,009 | B2 | 12/2008 | Baldwin | |
| 7,686,174 | B2 | 3/2010 | Willim | |
| 7,874,438 | B2 | 1/2011 | Despres | |
| 8,025,167 | B2 | 9/2011 | Schneider et al. | |
| 8,192,128 | B2 | 6/2012 | Orgeron | |
| 9,365,398 | B2 | 6/2016 | Benton et al. | |
| 2005/0287927 | A1 | 12/2005 | Berman et al. | |
| 2006/0001224 | A1 | 1/2006 | Bitter et al. | |
| 2006/0016100 | A1 | 1/2006 | Riha et al. | |
| 2006/0219650 | A1 * | 10/2006 | Gokita | B66C 23/707 212/350 |
| 2007/0059142 | A1 | 3/2007 | Dambroseo | |
| 2007/0163982 | A1 | 7/2007 | Lichinchi | |
| 2008/0061626 | A1 | 3/2008 | Busley et al. | |
| 2009/0057104 | A1 | 3/2009 | Boudreau | |
| 2010/0187194 | A1 | 7/2010 | Schuermann et al. | |
| 2010/0212185 | A1 | 8/2010 | Cooper et al. | |
| 2011/0214313 | A1 | 9/2011 | James et al. | |
| 2011/0272375 | A1 | 11/2011 | Hans-Dieter | |
| 2012/0017470 | A1 | 1/2012 | Pan | |
| 2012/0055041 | A1 | 3/2012 | Mackey et al. | |
| 2012/0251284 | A1 | 10/2012 | Lettau | |
| 2013/0020274 | A1 | 1/2013 | Munuswamy et al. | |
| 2013/0247425 | A1 | 9/2013 | Davis et al. | |
| 2014/0047690 | A1 | 2/2014 | Plantan et al. | |
| 2014/0048362 | A1 | 2/2014 | Plantan et al. | |
| 2014/0116975 | A1 | 5/2014 | Benton et al. | |
| 2015/0181976 | A1 | 7/2015 | Cooper et al. | |
| 2017/0029253 | A1 | 2/2017 | Richter et al. | |
| 2017/0305727 | A1 | 10/2017 | Schoonmaker | |

FOREIGN PATENT DOCUMENTS

| | | | | |
|---|---|---|---|---|
| DE | 29613042 | U1 | 9/1996 | |
| DE | 29613042 | U1 | 10/1996 | |
| DE | 202005005627 | U1 | 8/2006 | |
| DE | 202011100957 | U1 | 8/2011 | |
| EP | 1314682 | A2 | 5/2003 | |
| EP | 1342692 | A2 | 9/2003 | |
| EP | 1555237 | A2 * | 7/2005 | B66C 23/707 |
| EP | 2189413 | A1 | 5/2010 | |
| EP | 2202193 | A2 | 6/2010 | |
| JP | 2006306533 | A | 11/2006 | |
| JP | 2008265980 | A | 11/2008 | |
| JP | 2011042496 | A | 3/2011 | |
| JP | 2012041119 | A | 3/2012 | |
| JP | 5629160 | A | 11/2014 | |
| JP | 2016037342 | A | 3/2016 | |
| JP | 2016113218 | A | 6/2016 | |
| WO | 9858711 | A1 | 12/1998 | |
| WO | 2005092775 | A1 | 10/2005 | |
| WO | 2013007050 | A1 | 1/2013 | |

OTHER PUBLICATIONS

Machine Translation of CN 102398864 A. (Year: 2012).*
Machine Translation of CN 204622450 U. (Year: 2015).*
Extended European Search Report dated Jul. 18, 2018 issued in connection with corresponding European Patent Application No. 18159724.6.
Extended European Search Report dated Dec. 21, 2016 issued in connection with EP Pat. Appl. 16 181 455.3.
CNIPA First Office Action dated Jul. 3, 2020 issued in connection with corresponding Chinese Pat. Appl. No. 201810175394.2.

* cited by examiner

WEAR PAD WITH INSERT FOR TELESCOPING BOOM ASSEMBLY

BACKGROUND

The present disclosure relates generally to construction equipment and machines equipped with telescoping boom assemblies, such as cranes, teleloaders, and the like. In particular, the present application relates to the wear pads that are positioned between the nested sections of the telescoping boom assemblies.

Wear pads typically support, in part, the weight of a section of a telescoping boom assembly relative to another section of the telescoping boom assembly. Wear pads may also be configured to reduce the sliding friction between the adjacent sections of the telescoping boom assembly. Further, the wear pads typically are designed to be replaceable.

Known wear pads may be substantially rigid and are machined for a specific design and shape of a telescoping section. These wear pads may be formed as a plurality of sections to be installed around at least a portion of the telescoping section to form a substantially continuous wear pad. Another known wear pad is formed as a single piece and includes a plurality of grooves extending partially through its thickness to increase flexibility of the wear pad. Such a wear pad can be flexed during installation so as to substantially comply to a shape of the telescoping section on which it is installed. U.S. patent application Ser. No. 15/220,140 (published as US Pub. No. 2017/0029253), which is commonly owned with the present application by Manitowoc Crane Companies, LLC, and is incorporated herein by reference in its entirety, discloses such a wear pad.

The telescoping boom typically requires lubrication between adjacent telescoping boom sections, and in particular, between a wear pad and the telescoping boom section against which the wear pad bears. Liquid or semi-solid lubricants are used to reduce or prevent chattering, rough movement or operation while extending or retracting one telescoping section relative to another. However, the telescoping sections must be monitored to ensure adequate lubrication, and maintenance may be time consuming and messy with such lubricants.

Accordingly, there is a need for a wear pad that reduces or eliminates the need for lubrication between immediately adjacent telescoping boom sections.

SUMMARY

According to one aspect, there is provided a wear pad for a telescoping boom assembly. The wear pad includes a wear pad body having a first surface and a second surface oppositely positioned from the first surface and spaced from the first surface by a height of the wear pad body, a groove formed in one of the first surface and the second surface, the groove extending along a length of the wear pad body, and an insert positioned in the groove such that a portion of the insert projects outwardly from the groove. The wear pad is configured to be installed between an inner telescoping boom section and an immediately adjacent outer telescoping boom section.

According to another aspect, there is provided a telescoping boom assembly comprising an outer boom section and an inner boom section disposed in the outer section and configured for telescoping movement to extend out of and retract into the outer boom section. The telescoping boom assembly further includes a wear pad having a first surface and a second surface oppositely positioned from the first surface and spaced from the first surface by a height of the wear pad, a groove formed in one of the first surface and the second surface, the groove extending along a length of the wear pad, and an insert positioned in the groove, the insert having a portion which projects outwardly from the groove. The wear pad is installed at one of the inner boom section and the outer boom section and the insert is configured to contact the other of the inner boom section and the outer boom section.

According to yet another aspect, there is provided a telescoping boom assembly of a crane having an outer boom section and an inner boom section disposed in the outer boom section and configured for telescoping movement to extend out of and retract into the outer section. The assembly further comprises a first wear pad having a first surface and a second surface oppositely positioned from the first surface and spaced from the first surface by a height of the first wear pad, a groove formed in one of the first surface and the second surface, the groove extending along a length of the first wear pad, the groove having a depth, and an insert positioned in the groove, the insert having a height greater than the depth of the groove such that a portion of the insert projects outwardly from the groove. The assembly further includes a second wear pad. The first wear pad is installed at a rear portion of the inner boom section and is configured to move with the inner boom section relative to the outer boom section, and the second wear pad is installed at a forward portion of the outer boom section.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
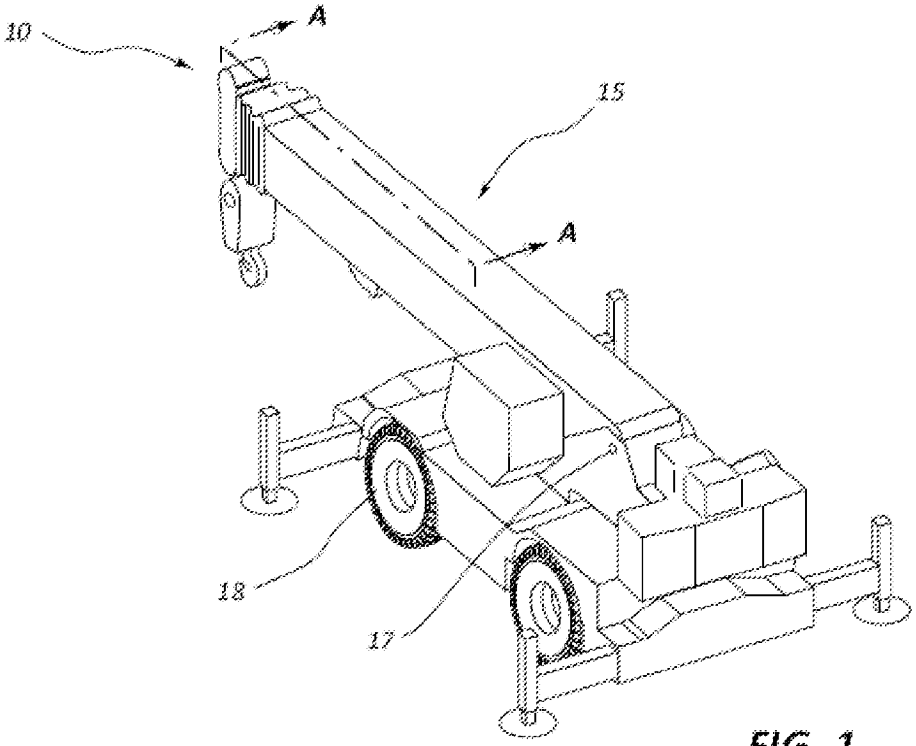
FIG. 1 is a perspective view of a construction vehicle with a telescoping boom assembly according to an embodiment described herein.

FIG. 1 illustrates a construction vehicle 10 that includes a telescoping boom assembly 15. The construction vehicle 10 may be configured with ground engaging members 18, such as wheels, tracks, rails, and the like to make the construction vehicle 10 mobile, or alternately the construction vehicle 10 may be fixed, such as on a platform (not shown).

In some embodiments, the construction vehicle 10 is a mobile crane, as illustrated in FIG. 1. Of course, the construction vehicle 10 may be a teleloader or any other type of construction vehicle that includes a telescoping boom assembly 15.

Figure 2:
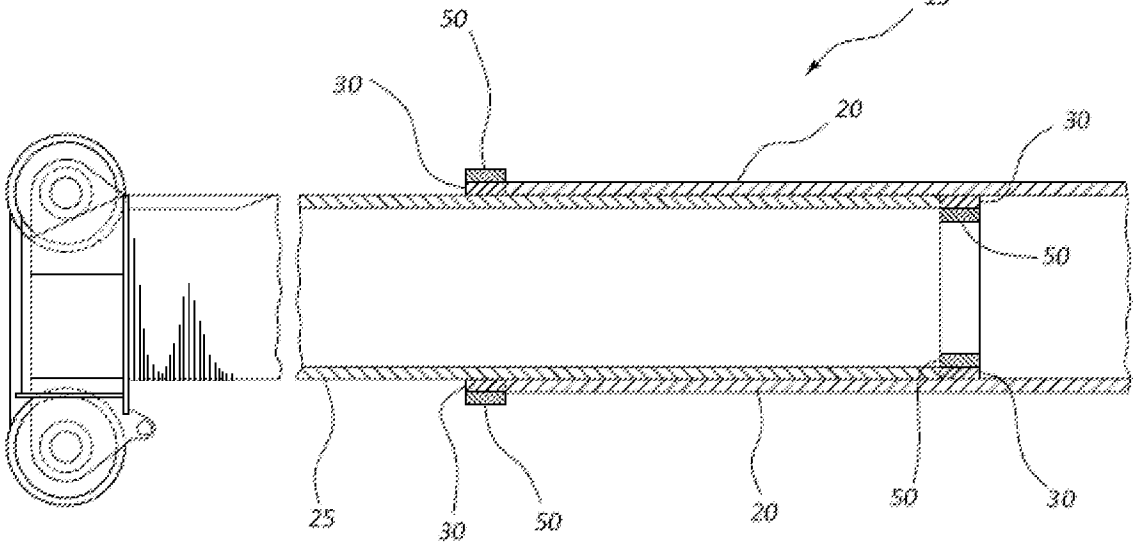
FIG. 2 is a cross-section A-A of the telescoping boom assembly in FIG. 1.

Illustrated in FIG. 2 is a cross-section A-A of the telescoping boom assembly 15 in FIG. 1. The telescoping boom assembly 15 may be rectangular in cross-section, but as will be appreciated, embodiments of the invention may be employed with telescoping boom assemblies that are square, rectangular, oval, segmented, or include one or more portions with a radius of curvature that is the same or different from the radius of curvature of another portion of the telescoping boom assembly.

The telescoping boom assembly 15 includes a first section 20 and at least a second section 25 configured to nest within, most typically, or nest around the first section 20. That is, the first section 20 may an outer telescoping boom section and the second section 25 may be an inner telescoping boom section. The second section 25 is capable of extending away from the first section 20 and retracting into the first section 20. Thus, in FIG. 2, the second section 25 would extend leftward and away from the first section 20 and the boom pivot 17 (FIG. 1). Of course, the telescoping boom assembly 15 may include a plurality of nested sections. The second section 25, as well as other nested telescoping sections (not shown) may be driven in an extending or retracting direction by a known linear actuator (not shown).

At least one wear pad 30 is positioned between the first section 20 and the second section 25 of the telescoping boom assembly 15. Optionally, brackets 50 coupled to one of the first section 20 and the second section 25 are configured to receive and/or retain the wear pad 30 in position relative to the first section 20 or the second section 25 to which it is adjacent.

Figure 3:
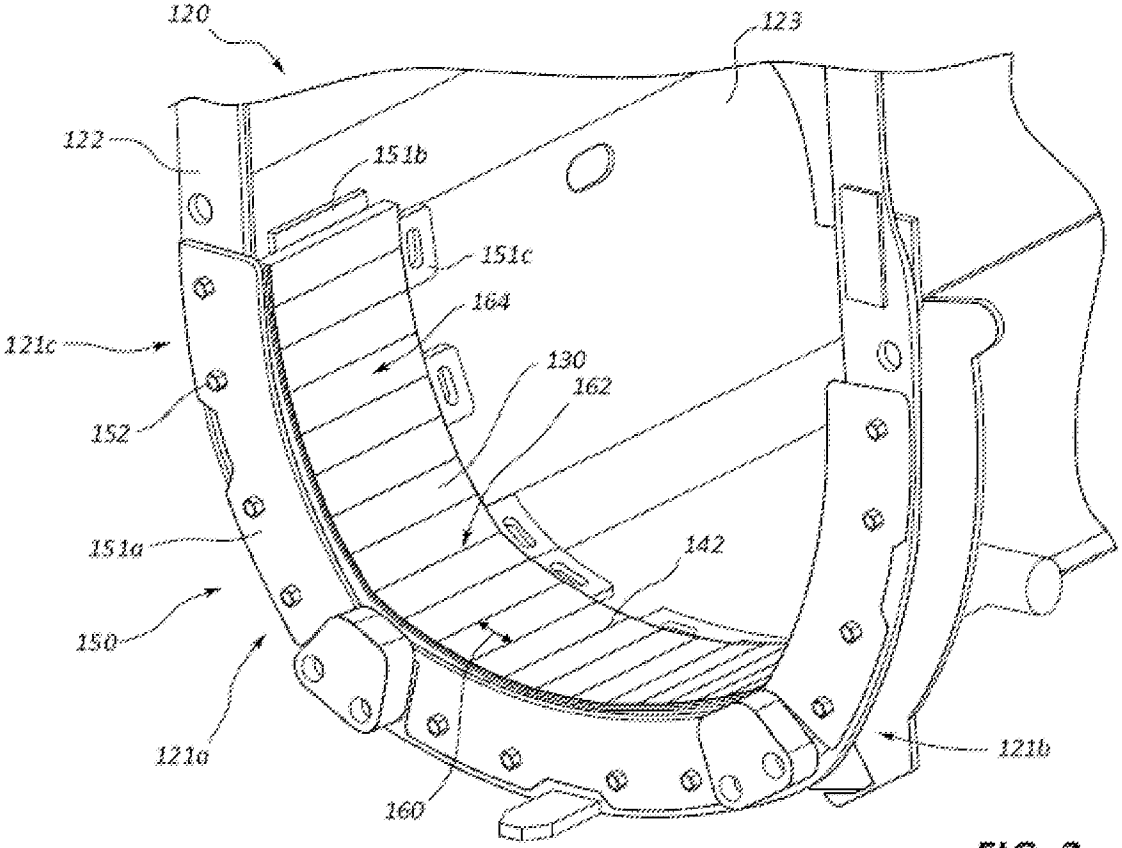
FIG. 3 is a perspective view of a first section of a telescoping boom assembly and associated wear pad according to an embodiment described herein.

Another embodiment of a first section 120 of a telescoping boom assembly 15 is illustrated in perspective view in FIG. 3. Note, a second section is not illustrated, but typically would be similar in appearance to the first section 120 as one of skill in the art would understand. In this instance, the first section 120 includes a plurality of portions 121*a*, 121*b*, 121*c*. Each portion 121*a*, 121*b*, 121*c* includes a radius of curvature that varies from the radius of curvature of at least one of the other portions 121*a*, 121*b*, 121*c*.

A wear pad 130 optionally is received within and/or retained in position by the bracket 150. The bracket 150 optionally includes at least one or more positioning members 151*a*, 151*b*, 151*c*. The positioning members 151*a*, 151*b*, 151*c* may be a tab, flange, recess, groove, ridge, or any other similar structure configured to receive and/or retain the wear pad 130. The positioning members 151*a*, 151*b*, 151*c* may be integrally formed with each other and/or with the first section 120. As illustrated in FIG. 3, the positioning members 151*a*, 151*b*, 151*c* may include a variety of flanges, made from plate steel and/or plastic for example, such as positioning member 151*a* that extend inward and away from a first end 122, and raised positioning members 151*b* and 151*c* that extend away from an inner surface 123 of the first section 120. The positioning members 151*a*, 151*b*, 151*c* may be adjustably fixed to the first section 120 with an attachment device 152, such as nuts, screws, bolts, slots and grooves, adhesives, and the like, that allow the positioning members 151*a*, 151*b*, 151*c* to be moved to accommodate manufacturing tolerances in the first section 120 and the wear pad 130.

Figure 4:
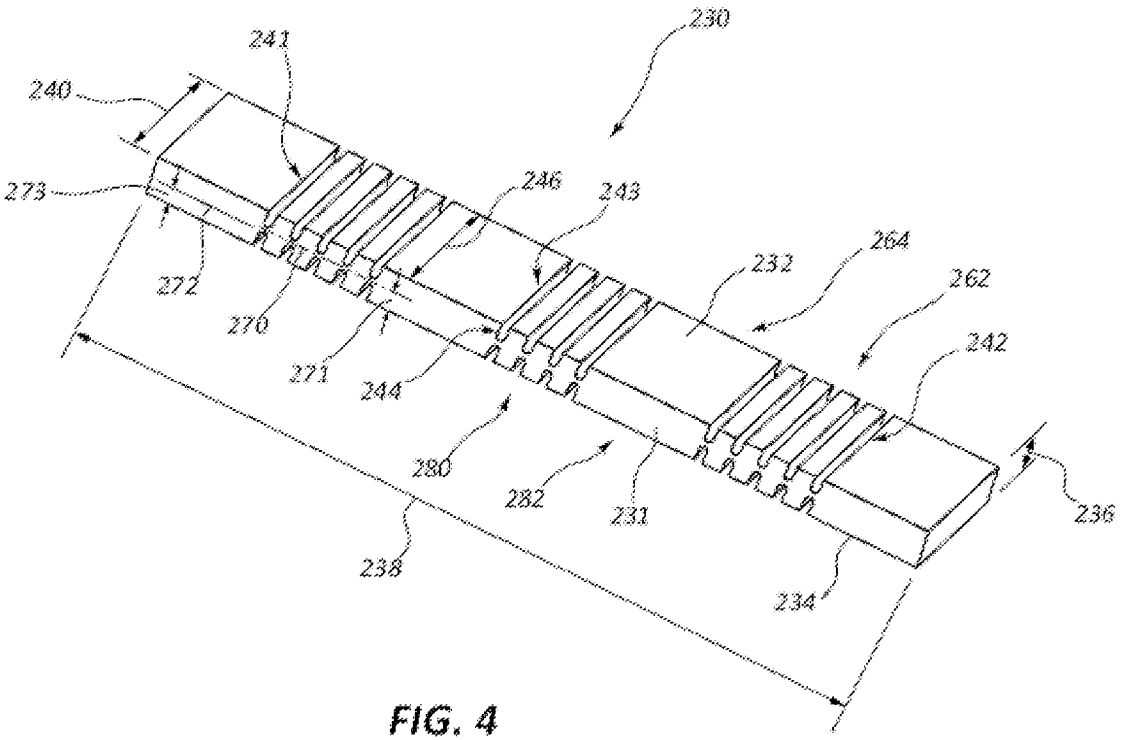
FIG. 4 is a perspective view of an embodiment of a wear pad in its uninstalled position according to an embodiment described herein.
Figure 5:
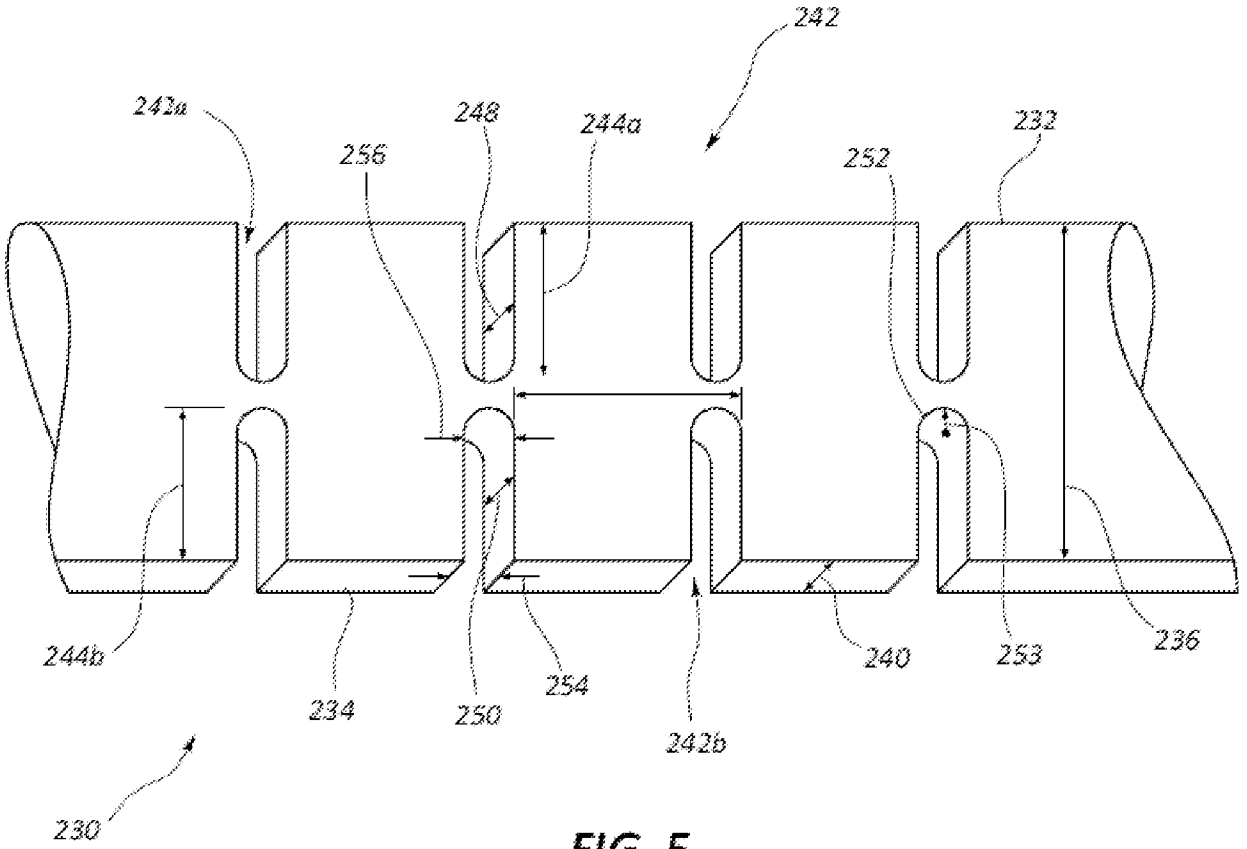
FIG. 5 is an enlarged perspective view of the wear pad in FIG. 4.
Figure 6:
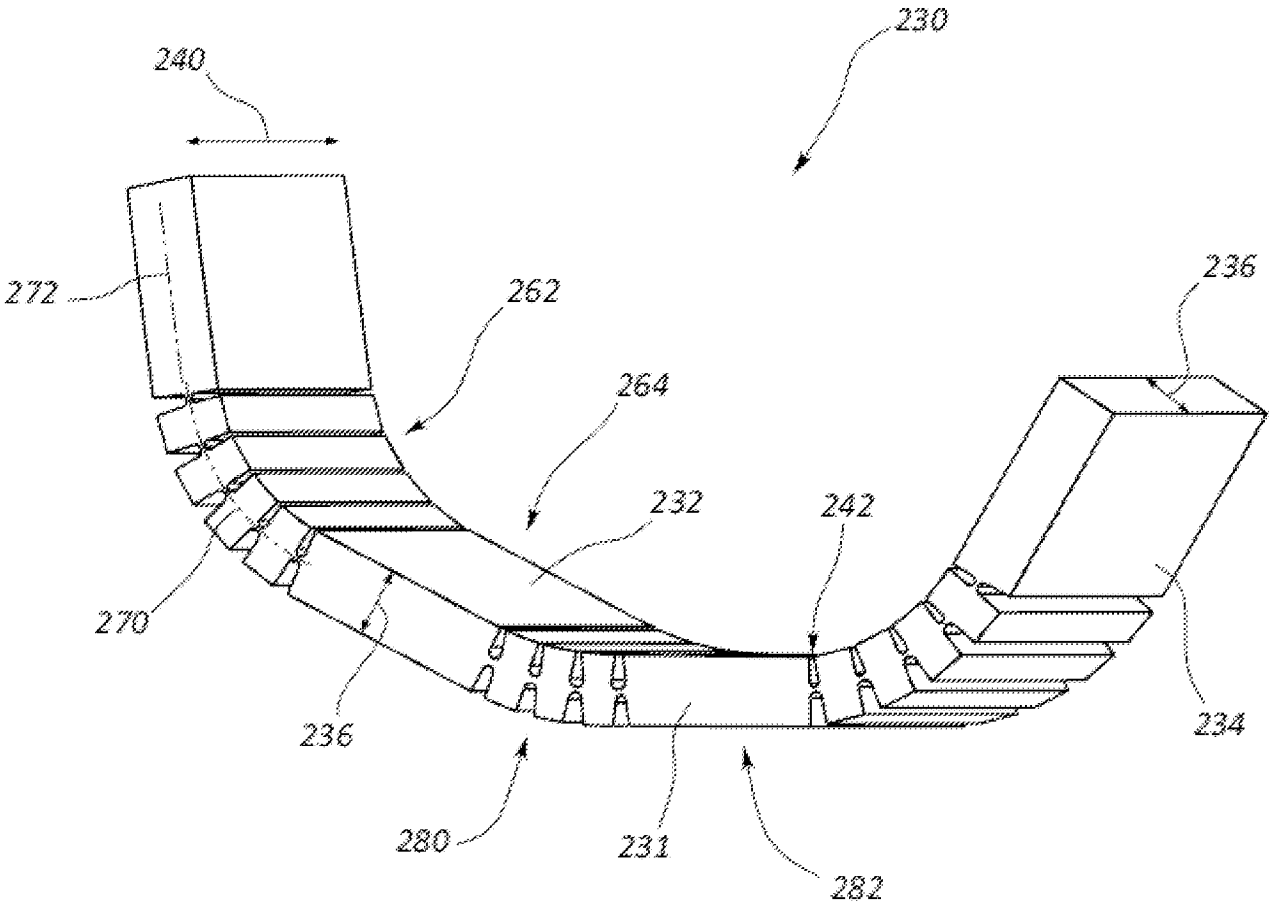
FIG. 6 is a perspective view of the wear pad in FIG. 4 in its installed position according to an embodiment described herein.
Figure 7:
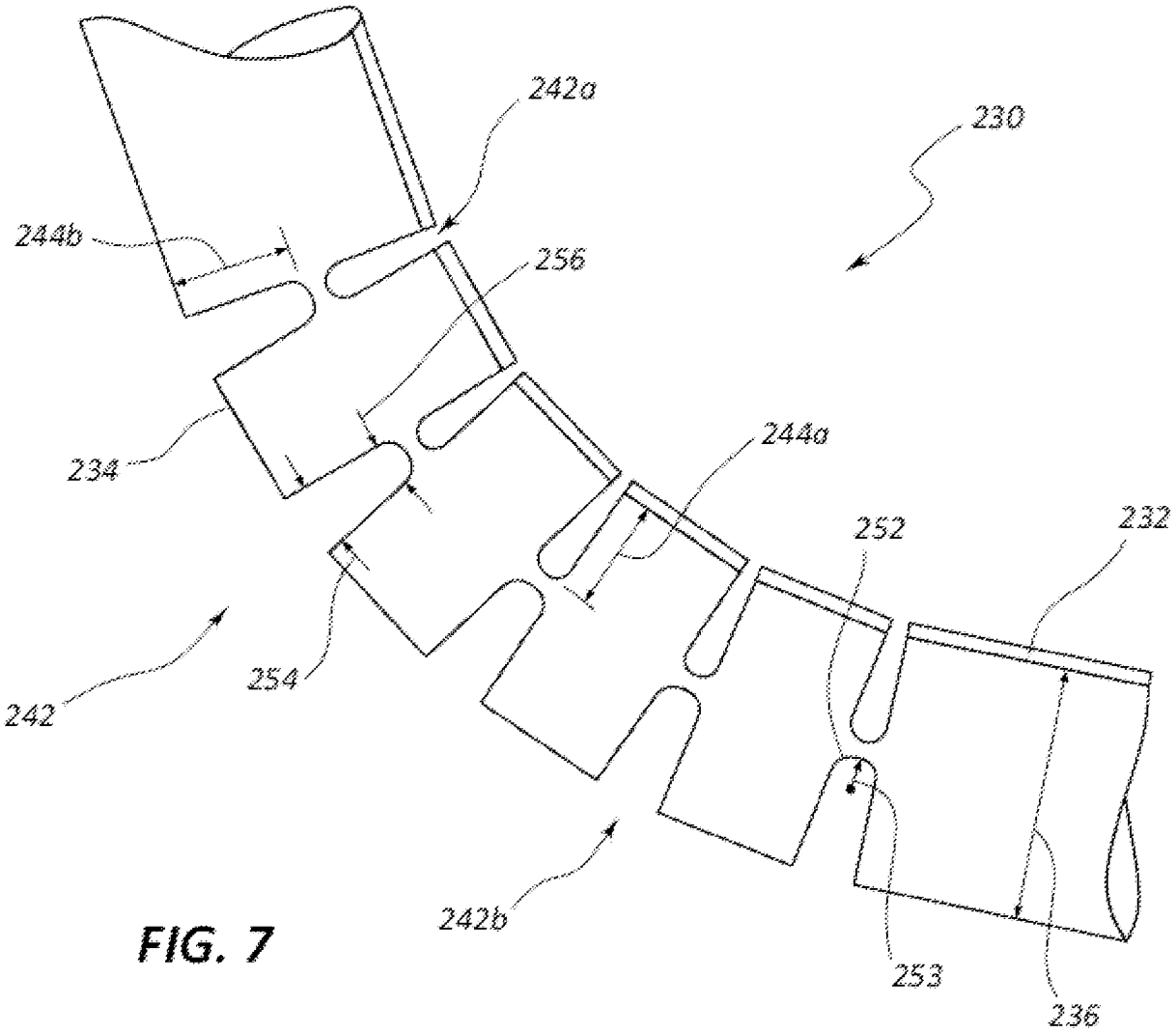
FIG. 7 is an enlarged side view of the wear pad in FIG. 6.

Turning to FIGS. 4-7, an embodiment of a wear pad 230 includes a first surface 232 and a second surface 234 oppositely positioned and spaced apart a thickness or height 236 from the first surface 232. The wear pad 230 also includes a length 238 and a width or depth 240. FIGS. 4 and 5 illustrate the wear pad 230 in the uninstalled position, while FIGS. 6 and 7 illustrate the wear pad 230 in an installed shape and orientation. As illustrated in FIGS. 4 and 5, the height 236 and depth 240 are significantly less than the length 238, which results in a wear pad 230 that is rectangular in shape. Optionally, the height 236 between the first surface 232 and the second surface 234 is substantially the same across at least one of the length 238 and a width 240 of the wear pad 230. In yet other embodiments, the height 236 between the first surface 232 and the second surface 234 may be configured to vary less than 10 percent of an average height across at least one of the length 238 and the width 240 of the wear pad 230.

Various heights, lengths, and depths of the dimensions or measurements of the wear pad, however, can be used in various embodiments of the wear pad. Further, the terms height, depth, and length as used herein merely distinguish the various dimensions and do not connote the magnitude of a given dimension relative to the other dimensions. Consequently, wear pads of other shapes, including square, oval, round, and other geometric shapes are contemplated. In other shapes, such as ovals and circles, the major and minor axes correspond to the terms length and depth as appropriate.

In one embodiment, the wear pad 230 includes a body 231 (FIG. 4) made from a material. In one embodiment, the body 231 is made of a wear-resistant material that has a relatively low coefficient of friction relative to other materials. In some embodiments, the material of the body 231 is a metal. In yet other embodiments, the material of the wear pad body 231 is a plastic, thermoplastic, thermoset, or other similar materials. For example, the material of body 231 may be nylon or nylon-based materials. Optionally, the wear pad 230 includes a friction modifier (not illustrated) that reduces the coefficient of friction of the body material further. The friction modifier optionally includes at least one of a lubricant applied to at least one of the first surface 232 and the second surface 234 of the body 231 and a lubricant integral to the material of the wear pad body 231. For example, the wear pad body 231 may be impregnated with molybdenum, and/or oils, and/or other wet and/or dry lubricants.

The wear pad 230 includes at least one recess 242 in at least one of the first surface 232 and the second surface 234 of the body 231. In some embodiments, the wear pad 230 includes a plurality of recesses 242. The first surface 232 and the second surface 234 could be a top surface and bottom surface in some embodiments, while in alternative embodiments the first surface and the second surface could be a front and rear of the wear pad or a left side and a right side, for example. As illustrated in FIG. 4, the wear pad 230 optionally includes at least one recess 242*a* in the first surface 232 and at least another recess 242*b* in the second surface 234.

The recess 242 extends at least partly across a dimension of the wear pad 230. For example, the recesses 242*a* and 242*b* extend fully across the depth 240 of the wear pad 230. In other embodiments, the recesses 242 extend only partly across the depth 240 and/or the length 238 of the wear pad 230. As illustrated in FIG. 4, at least one recess 242 is oriented parallel to the depth 240 of the wear pad 230, although the recess 242 or other recesses in the plurality of recesses may be parallel to another dimension, such as the height 236 or the length 238, or not parallel to any of the dimensions.

The recess 242 extends a depth 244 into at least one of the first surface 232 and the second surface 234, wherein the depth 244 is less than the height 236 between the first surface 232 and the second surface 234. As illustrated in FIG. 4, the recess 242*a* in the first surface 232 extends a depth 244*a* into the first surface 232, and the recess 242*b* extends a depth 244*b* into the second surface 234, each depth 244*a* and 244*b* being less than the height 236. Optionally, and as illustrated in FIG. 5, a sum of the depth 244*a* of the first recess 242*a* and the depth 244*b* of the second recess 242*b* is less than the height 236.

Optionally, the wear pad 230 includes at least a portion 241 of the plurality of recesses 242 that are parallel to at least another portion 243 of the plurality of recesses 242. Alternatively, the portion 241 of the plurality of recesses 242 may be only partially parallel, i.e., parallel over a segment or a length of the groove to another portion 243 of the plurality of recesses 242 (not illustrated), or in yet other embodiments a portion 241 of the plurality of recesses 242 may not parallel another portion 243 of the plurality of recesses 242 (not illustrated).

Referring to FIG. 5, in one embodiment, at least one recess 242*a* optionally includes a first axis 248. At least another recess 242*b* optionally includes a second axis 250. In some embodiments, the first axis 248 and the second axis 250 are parallel. Optionally, the first axis 248 and the second axis 250 are in a plane parallel to at least one of the height 236, the length 238, or the depth 240. Of course, the first axis 248 and the second axis 250 may not be parallel in other embodiments.

The recess 242 optionally includes a root 252 with a radius of curvature 253 in some embodiments. In other embodiments, the root 252 is the intersection of two planes. As illustrated by comparing FIGS. 5 and 7, the radius of curvature 253 of the root 252 may change between the uninstalled position of the wear pad (FIG. 5) and the installed position (FIG. 7).

FIG. 5 also illustrates an optional feature in which the at least one recess 242 includes a first width 254 proximate at least one of the first surface 232 and the second surface 234 and a second width 256 proximate the root 252 of the at least one recess 242. In the uninstalled position illustrated in FIG. 5, the first width 254 is approximately the same as the second width 256. In other embodiments, in the uninstalled position of the wear pad 230, the first width 254 is greater than the second width 256, and yet in other embodiments the first width 254 is less than the second width 256. The first width 254 and the second width 256 may change when the wear pad is positioned in the installed position, as illustrated in FIG. 7.

In those embodiments of a wear pad 230 in which there exists a plurality of recesses 242, there exists a pitch 260 (FIG. 5) that defines the distance between the same structure or feature on adjacent recesses 242. Thus, in some embodiments, the wear pad 230 includes a first portion 262 with a given pitch 260 between adjacent recesses 242 and a second portion 264 with a different pitch 260, as illustrated in FIG. 4. FIG. 3 also illustrates the concept in which the pitch 160 of the recesses 142 differs between a first portion 162 and a second portion 164.

The wear pad 230 may include at least a first bending plane 270 positioned a first distance 271 between the first surface 232 and second surface 234, as illustrated in FIG. 4. In some embodiments there exists a second bending plane 272 positioned a second distance 273 between the first surface 232 and the second surface 234. A bending plane or neutral plane is the plane in which neither compressive forces nor tensile forces act. In FIGS. 4-7, the first bending plane 270 and the second bending plane 274 are equidistant between the first surface 232 and the second surface 234 so that the first distance 271 and second distance 273 are substantially the same (e.g., within 10% of the distance of the other). In other embodiments, however, and as will be discussed below, the first distance may be different from the second distance.

The wear pad 230 also may include a first portion 280 that includes at least one recess 242 and has a first bending stiffness, as illustrated in FIG. 4. The wear pad 230 also may have a second portion 282 that has a second bending stiffness. The second portion may have none, one, or a plurality of recesses 242 within the second portion 282. Further, the bending stiffness of the second portion 282 may be different than the bending stiffness of the first portion 280, which is typically the case, although in other embodiments the bending stiffness in the first portion 280 and the second portion 282 are the same. As illustrated in FIG. 4, the bending stiffness of the second portion 282 is greater than the bending stiffness of the first portion 280.

The bending stiffness is the resistance of the wear pad 230 against bending deformation, such as may occur when installing the wear pad 230 and once the wear pad 230 is installed between the first section 20 and the second section 25 of the telescoping boom assembly 15. The bending stiffness is a function of the elastic modulus of the wear pad 230 (i.e., a function of the material from which the body 231 is made), the area moment of inertia of the cross-section of the wear pad 230 about the axis of interest, the length of the wear pad 230, and the boundary conditions (i.e., the forces applied at the ends and surfaces of the wear pad 230, amongst other locations).

The first portion 262 and/or the second portion 264 with the pitch of the recesses 242 of the wear pad 230 may be the same portion or a different portion from one or more of the first and second portions 270, 272 with the bending planes. Likewise, the first portion 262 and/or the second portion 264 may be the same portion or a different portion from one or more of the first and second portions 280, 282 of bending stiffness. Similarly, the first portion 270 and/or the second portion 272 of the bending plane may be the same portion or a different portion from one or more of the first and second portions 280, 282 of bending stiffness.

Figure 8:
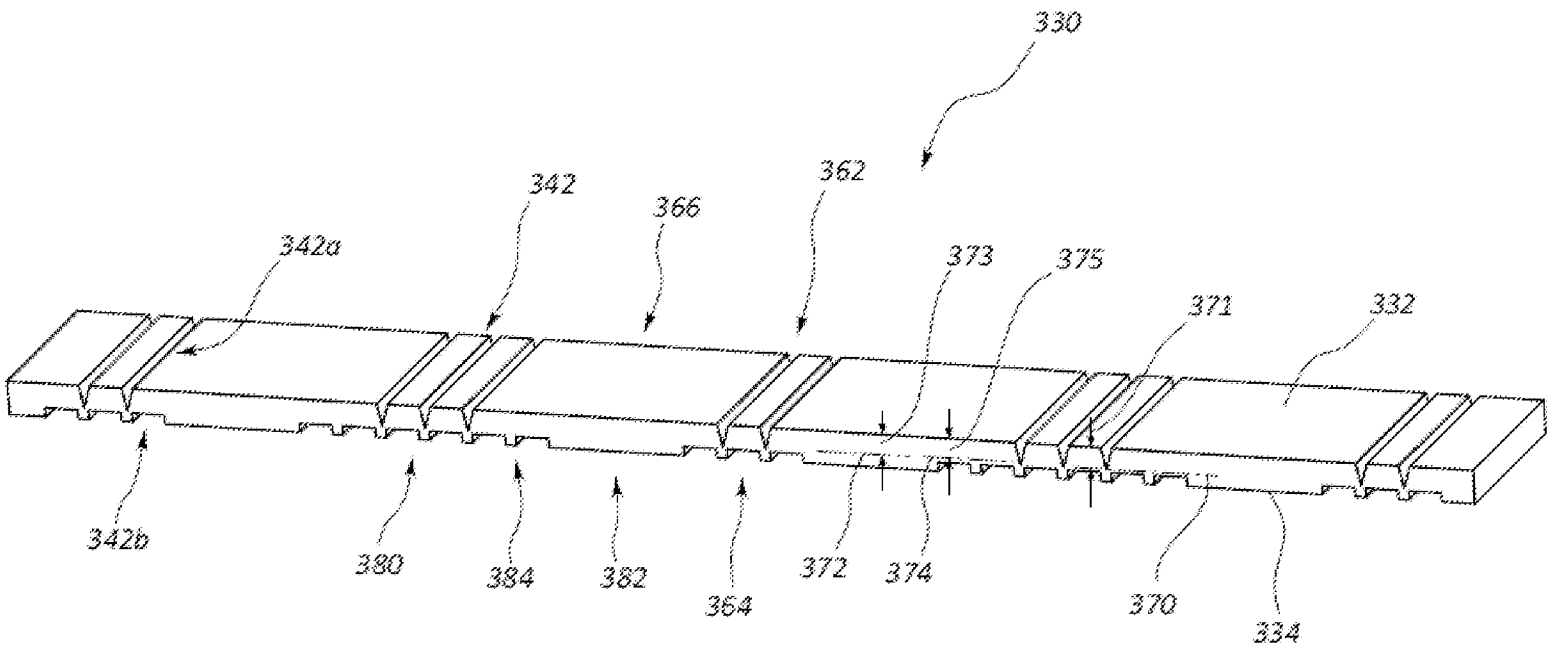
FIG. 8 is a perspective view of another embodiment of a wear pad in its uninstalled position.
Figure 9:
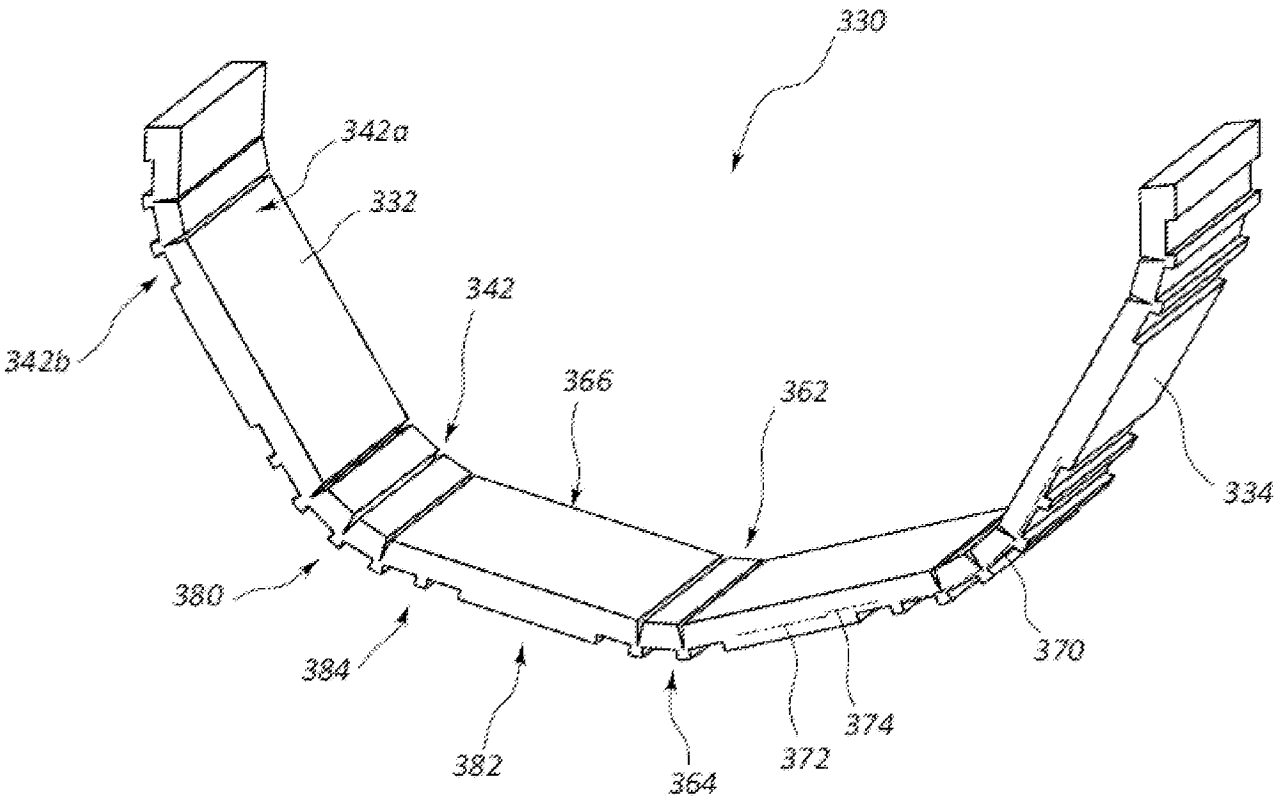
FIG. 9 is a perspective view of the wear pad in FIG. 8 in its installed position according to an embodiment described herein.
Figure 10:
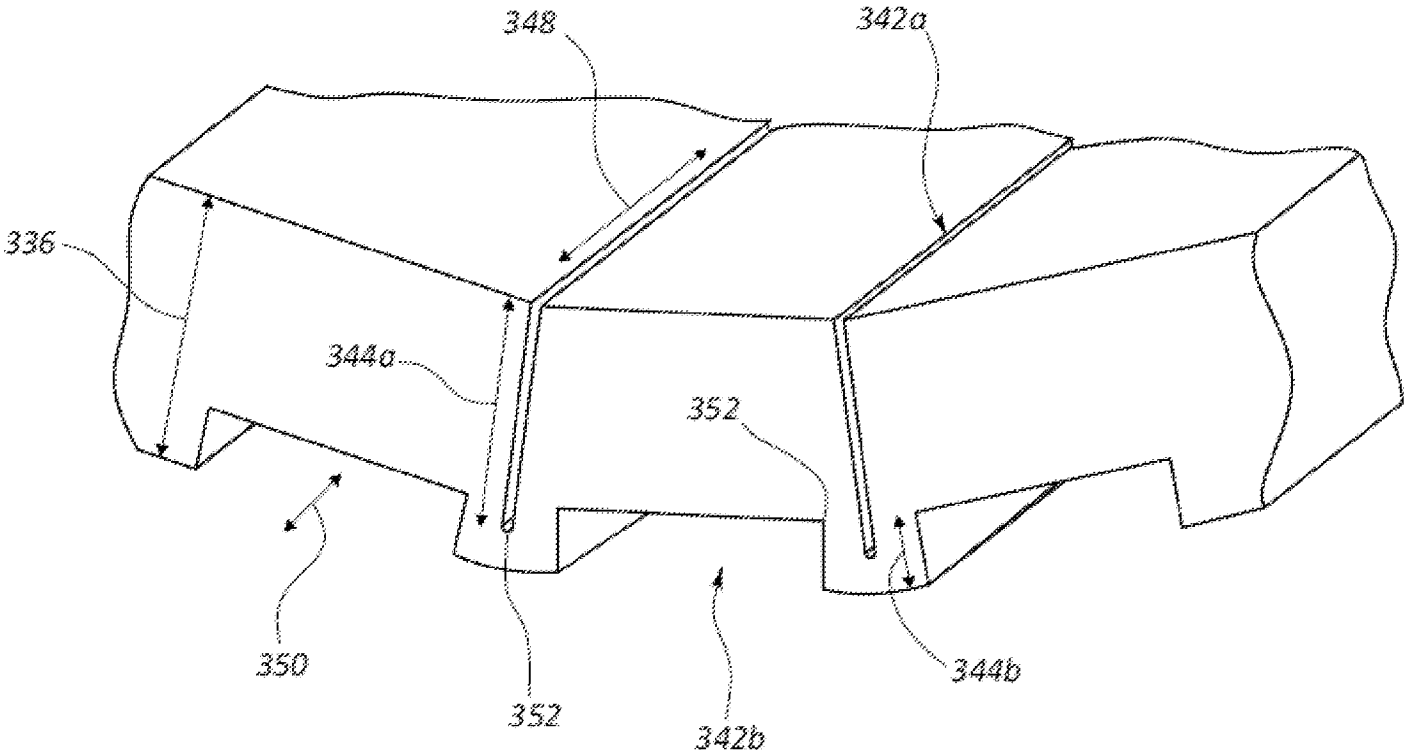
FIG. 10 is an enlarged perspective view of the wear pad in FIG. 9.

FIGS. 8-10 illustrate another embodiment of a wear pad 330. The wear pad 330 optionally incorporates any combination, including all, of the features recited above with respect to wear pad 230. Thus, the discussion of wear pad 330 focuses on the apparent differences.

The wear pad 330 includes a plurality of recesses 342 on both the first surface 332 and the second surface 334. The wear pad 330 includes a first portion 362 with a given pitch between adjacent recesses 342, a second portion 364 with another pitch between adjacent recesses 342, and a third portion 366 with yet another pitch between adjacent recesses 342. Thus, it can be seen that there may be any number of portions of a wear pad with given pitches between grooves, which may be different and/or the same (e.g., the pitch in the first portion 362 is the same as the pitch in the second portion 364, which are both different from the pitch in the third portion 366). In wear pad 330, each of the pitches in the first portion 362, second portion 364, and third portion 366 are different from the others.

The wear pad 330 may include at least a first bending plane 370 positioned a first distance 371 between the first surface 332 and second surface 334, as illustrated in FIG. 8. In some embodiments there optionally exist one or more additional bending planes. In the wear pad 330 there exists a second bending plane 372 positioned a second distance 373 between the first surface 332 and the second surface 334. There also exists a third bending plane 374 positioned a third distance 375 between the first surface 332 and the second surface 334. As illustrated in FIG. 8, the first distance 371, the second distance 373, and the third distance 375 are all different from each other.

Optionally, the wear pad 330 also may include a first portion 380 that includes at least one recess 342 and has a first bending stiffness, as illustrated in FIG. 8. The wear pad 330 also may have one or more additional portions. For example, the wear pad 330 includes a second portion 382 that has a second bending stiffness. The second portion may have none, one, or a plurality of recesses 342 within the second portion 382. The wear pad 330 includes, in this example, a third portion 384 that has a third bending stiffness. The bending stiffness of the second portion 382 and the third portion 384 may be different than the bending stiffness of the first portion 380; although in other embodiments the bending stiffness in one or more of the portions may be the same. As illustrated in FIG. 8, the bending stiffness of the second portion 382 is greater than the bending stiffness of the first portion 380 and the third portion 384, and the bending stiffness of the third portion 384 is greater than the bending stiffness of the first portion 380.

Turning to FIG. 10, additional optional differences with the wear pad 330 are identified. At least one recess 342*a* optionally includes a first axis 348. At least another recess 342*b* optionally includes a second axis 350. In contrast to the wear pad 230, the first axis 348 and the second axis 350 may not be parallel and/or may not lie in a plane parallel to one of the height, length, or depth of the wear pad 330. Thus, in this configuration the sum of the depth 344*a* of the recess 342*a* and the depth 344*b* of the recess 342*b* is greater than the depth 336 of the wear pad 330 because the recesses 342*a* and 342*b* are offset from each another.

In addition, the recesses 342*a* and 342*b* optionally include a root 352 that is an intersection of two planes, at least within manufacturing tolerances. Thus, any root 352 has a minimal radius of curvature in its uninstalled position illustrated in FIG. 8. As illustrated by comparing FIGS. 8 and 10, the radius of curvature of the root 352 may change between the uninstalled position of the wear pad 330 (FIG. 8) and the installed position (FIGS. 9 and 10).

Figure 11:
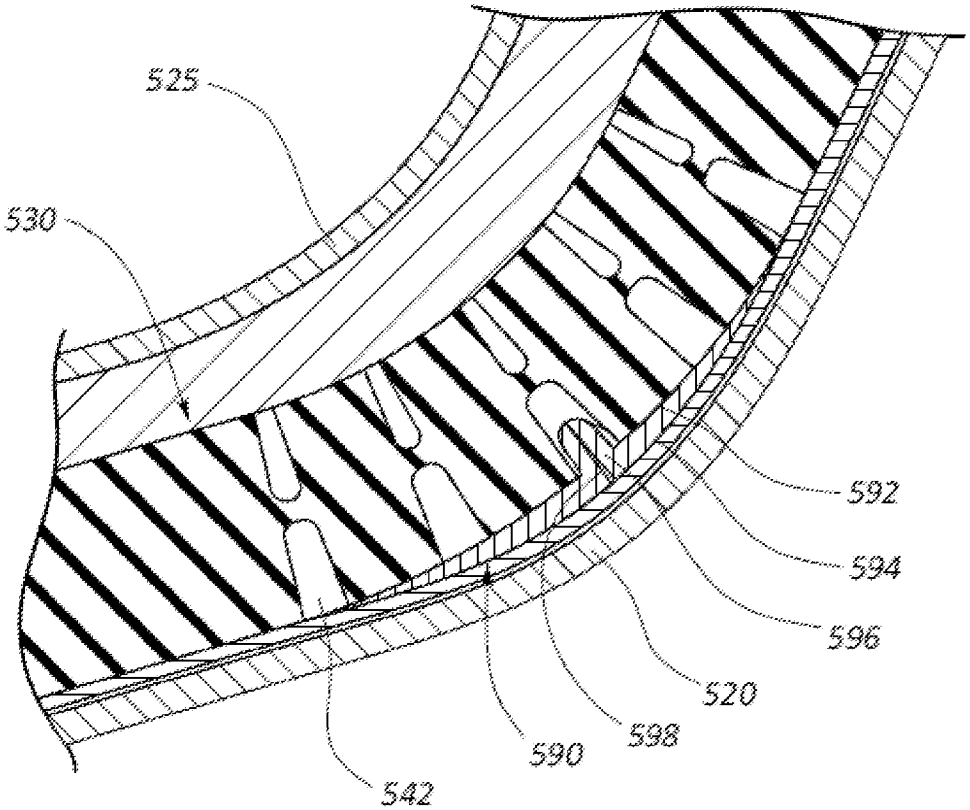
FIG. 11 is an enlarged cross-section view of the wear pad in FIG. 6 installed in a telescoping boom assembly with an associated shim according to an embodiment described herein.

Turning to FIG. 11, the construction vehicle 10 optionally includes at least one shim 590. Illustrated in FIG. 11 is a cross-section of a first section 520 and the second section 525 of a telescoping boom assembly similar to the telescoping boom assembly 15 in FIG. 1. A wear pad 530 with at least one recess 542 is positioned between the first section 520 and the second section 525. A shim 590, which may be manufactured from any material, but typically is formed of a thermoset, thermoplastic, metal, or other material, such as polytetrafluoroethylene (PTFE) may be positioned between one of the wear pad 530 and the first section 520 (most typically) or the wear pad 530 and the second section 525. The shim 590 allows for a better fit and accounts for manufacturing tolerances when positioning the wear pad 530 between the first section 520 and the second section 530.

The shim 590 includes at least a first surface 592 and a second surface 594 spaced apart from the first surface 592. Optionally, the shim 590 includes one or more ridges or protrusions 596 extending away from at least one of the first surface 592 and the second surface 594. As illustrated, the ridge 596 extends from the first surface 592 and is configured to be received in or extend into at least one of the recesses 542. In other words, the ridge 596 is dimensionally shaped (height, width, radius of curvature at a tip of the ridge) so as to fit within—whether loosely or with an interference fit—at least one recess 542.

Methods of manufacturing a wear pad are also disclosed. The method includes obtaining a material having a length, a first surface, and a second surface spaced apart a height from the first surface. The method further includes forming at least one recess that extends a depth into at least one of the first surface and the second surface, wherein the depth is less than the height between the first surface and the second surface. The recess may be formed by at least one of milling, sawing, molding, and ablating the material.

Optionally, the method includes forming a plurality of recesses. In such methods, at least a portion of the plurality of recesses may be formed parallel to at least another portion of the plurality of recesses. Optionally, the pitch of the plurality of recesses in a first portion of the material may differ from the pitch of the plurality of recesses in a second portion of the material.

Further, the step of forming at least one recess may include forming at least one recess in the first surface and forming at least another recess in the second surface. In such embodiments, the at least another recess extends a depth into the second surface less than the height between the first surface and the second surface.

The step of forming the at least one recess may include forming the at least one recess to include a first axis and forming the at least another recess to include a second axis, wherein the first axis and the second axis are parallel, and wherein a sum of the depth of the first recess and the depth of the second recess is less than the height between the first surface and the second surface.

The step of forming the at least one recess may include forming a root that includes a radius of curvature in the at least one recess.

The step of forming the at least one recess may include forming the at least one recess to include a first width proximate at least one of the first surface and the second surface and a second width proximate a root of the at least one recess, and wherein the first width is greater than the second width.

The step of forming the at least one recess may include orienting the at least one recess to be parallel to the length of the material.

The method may further include obtaining a material that includes a friction modifier integral to the material. Likewise, the method optionally includes applying a lubricant to at least one of the first surface and the second surface.

The method optionally includes obtaining or forming a material such that the height between the first surface and the second surface is substantially the same across at least one of the length and the width of the material. Optionally, the height between the first surface and the second surface is configured to vary less than 10 percent of an average height across at least one of the length and the width of the material.

The method optionally includes modifying a position of a first bending plane of a first portion of the material such that the first bending plane differs from a second bending plane of a second portion of the material.

The method also optionally includes modifying a first bending stiffness of a first portion of the material such that the first bending stiffness differs from a second bending stiffness of a second portion of the material.

Methods of installing a wear pad in position between a first section and a second section of a telescoping boom assembly of a crane are also disclosed. The method includes providing a wear pad that includes a length, a first surface and a second surface spaced apart a height from the first surface, and at least one recess that extends a depth into at least one of the first surface and the second surface, wherein the depth is less than the height between the first surface and the second surface. The method also includes positioning the wear pad between the first section and the second section of a telescoping boom assembly.

Yet another method of installing a wear pad in position between a first section and a second section of a telescoping boom assembly of a crane includes providing a wear pad that includes a length, a first surface and a second surface spaced apart a height from the first surface, a first portion having a first bending stiffness, and a second portion having a second bending stiffness, wherein the second bending stiffness is different than the first bending stiffness. Optionally, the height between the first surface and the second surface is substantially the same in the first portion and the second portion. The method further includes positioning the wear pad between the first section and the second section of a telescoping boom assembly.

Yet another method of installing a wear pad in position between a first section and a second section of a telescoping boom assembly of a crane includes providing a wear pad that includes a length, a first surface and a second surface spaced apart a height from the first surface, a first portion having a first bending plane, and a second portion having a second bending plane, wherein the position (i.e., the distance between the first surface and the second surface) of the second bending plane is different than the first bending plane. Optionally, the height between the first surface and the second surface is substantially the same in the first portion and the second portion. The method further includes positioning the wear pad between the first section and the second section of a telescoping boom assembly.

Yet another method of installing a wear pad in position between a first section and a second section of a telescoping boom assembly of a crane includes providing a wear pad that includes a length, a first surface and a second surface spaced apart a height from the first surface, and at least a plurality of grooves that extends a depth into at least one of the first surface and the second surface, wherein the depth is less than the height between the first surface and the second surface. The plurality of grooves in a first portion has a first pitch and the plurality of grooves in a second portion has a second pitch. The method further includes positioning the wear pad between the first section and the second section of a telescoping boom assembly.

The methods of installing the wear pad optionally include positioning at least one shim, the at least one shim including at least one ridge, such that the ridge extends at least partially into the at least one recess of the wear pad.

Optionally, the positioning of the wear pad in the various methods further includes one of (a) positioning the wear pad within an interior of the first section of the telescoping assembly and positioning the wear pad onto an exterior of the second section of the telescoping assembly and (b) positioning the second section of the telescoping assembly within the first section of the telescoping assembly.

The embodiments above describe shape-compliant wear pads that are configured to flex so as to fit around or within a telescoping section of a boom. In one embodiment, the shape-compliant wear pads described above may be fit around or within telescoping sections having different sizes, shapes or sections of varying curvature, for example.

According to the embodiments described herein, and with reference to FIGS. 12-14, the wear pads described above with reference to FIGS. 2-11, as well as wear pads described in embodiments below, may further include an insert 602. The insert 602 is preferably a low-friction material or dry or solid lubricant, such as polytetrafluorethylene (PTFE), graphite, and molybednum disulfide. It is understood that the insert 602 may be formed completely by one of these materials or as a composite or blend including at least one of these materials.

The insert 602 is preferably a flexible material so that it may substantially conform in shape with a profile of a telescoping boom section and/or a shape of a wear pad. In one embodiment, when used in conjunction with a shape-compliant wear pad, such as those described above, the insert 602 is configured to flex or bend with the wear pad. Such a flexible insert 602 may also be used in conjunction with a substantially rigid or machined wear pad having a preformed shape, as described further below.

Also, as will be described, the insert 602 is configured to be secured to a wear pad by way of an interlocking fit in a groove of the wear pad. In addition, the insert 602 is positioned or retained in the groove such that a portion of the insert 602 projects outwardly from the groove beyond a surface of the wear pad. For example, in one embodiment, the insert 602 has a height that is greater than a depth of the groove in the wear pad such that the insert 602 projects from wear pad. In another embodiment, the insert may be disposed on a step or one or more spacers or shims within the groove so that a portion of the insert 602 projects from the groove. Thus, in the embodiments described above, the wear pads may be further formed with a groove configured to receive and/or retain the insert 602 in a manner described below with reference to FIGS. 12-34. In one embodiment, the wear pads may be formed with a plurality of grooves for receiving respective inserts 602. The grooves may extend substantially parallel to one another.

The groove extends in a length direction of the wear pad, which corresponds to a peripheral or circumferential direction of the telescoping boom section (i.e., a direction extending around the periphery or about a longitudinal axis of the boom section). In one embodiment, the wear pad may have the groove formed in an outer or convex surface. In such an embodiment, the wear pad is installed at an inner telescoping boom section and the insert 602 projects outwardly from the wear pad. The insert 602 is configured to move with the inner telescoping boom section and to contact an inner surface of an immediately adjacent outer telescoping boom section so as to slide against the inner surface of the outer telescoping boom section during extension and retraction of the inner telescoping boom section. In this embodiment, the wear pad may be positioned at a rear, or proximal end of the inner telescoping boom section.

Alternatively, the groove may be formed on an inner or concave surface of the wear pad. In such an embodiment, the wear pad is installed at an outer telescoping boom section and the insert 602 projects inwardly. The insert 602 is configured to contact an outer surface of an immediately adjacent inner telescoping boom section and slide against the outer surface of the inner telescoping boom section during extension and retraction of the inner telescoping boom section. In such an embodiment, the wear pad may installed a front, or distal end of the outer telescoping boom section, and the inner telescoping boom section moves relative to the wear pad. In some embodiments, a wear pad having the groove and insert positioned on an outer side and another wear pad having the groove and insert position on an inner side may be used together as a wear pad system in a telescoping boom.

Figure 12:
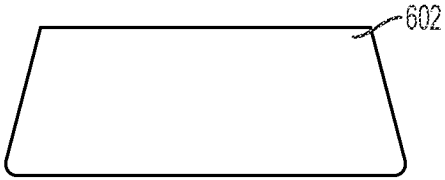
FIG. 12 is an end view showing an example of an insert for use with a wear pad according to an embodiment described herein.

FIG. 12 is an end view of the insert 602 according to an embodiment described herein. FIG. 13 shows the insert 602 of FIG. 12 in a curved or flexed condition, such as when the insert 602 is an installed condition with the wear pad on the boom. FIG. 14 is a side view of the insert of FIG. 12 in an uninstalled or un-flexed (relaxed) condition, where surfaces of the insert 602 are not placed under tensile or compressive forces. Referring to FIGS. 12-14, and in particular FIG. 12, the insert may be substantially trapezoidal in shape. Accordingly, the insert 602 may be fit into a correspondingly shaped groove, described further below, on the wear pad in a dovetail relationship. However, it is understood that other shapes allowing for an interlocking fit with a groove in the wear pad are suitable as well. That is, the insert 602 is not limited to the substantially trapezoidal shape shown in FIG. 12, and the groove is not limited to a corresponding substantially trapezoidal shape.

Other shapes which allow for an interlocking fit between the groove and the insert 602 to retain the insert 602 within the groove when subjected to forces regularly applied during telescoping boom operation are suitable as well. In addition, it is not necessary that a cross-sectional shape of the groove and the insert 602 correspond in their entireties. So long as at least a portion of the respective shapes of the groove and the insert 602 correspond in way that the insert 602 is retained in the groove during normal operation of the telescoping boom, such shapes are suitable. For example, the insert 602 may include one or more projections, such as a tab or tongue, configured for receipt in a corresponding retaining slot or the like in the groove, or vice versa. Alternatively, or in addition, known fasteners may be used to retain the insert 602 in the groove, such as adhesives or mechanical fasteners. That is, fasteners may be used to retain the insert 602 in the groove in addition, or instead of, corresponding shapes that provide an interlocking fit between the insert 602 and groove.

Figure 13:
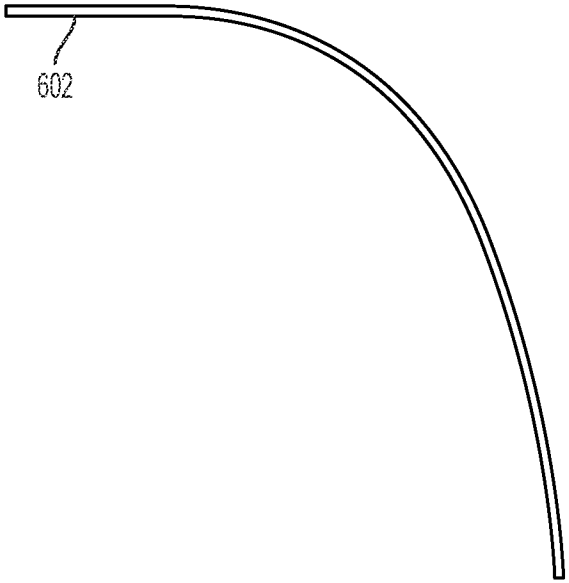
FIG. 13 is a side view of the insert of FIG. 12 in a flexed condition.
Figure 14:
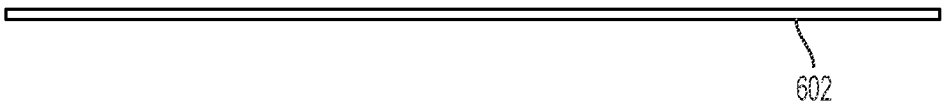
FIG. 14 is a side view of the insert of FIG. 12 in a relaxed condition.

Referring to FIGS. 13 and 14, the insert 602 preferably has enough flexibility to flex from a substantially flat or uninstalled condition (see FIG. 14) to a substantially curved or installed condition (see FIG. 13). In one embodiment, the insert 602 is elastically flexible. The insert 602 is configured to flex to correspond to different radii of curvature that may be found in different wear pads or around different telescoping boom sections. For example, in one embodiment, the insert 602 may bend around a radius of curvature of approximately 165 mm-175 mm. However, it will be appreciated that the insert 602 may be sized, shaped or otherwise configured to bend around radii of curvature larger or smaller than the range above, depending particular boom section and wear pad dimensions.

Figure 15:
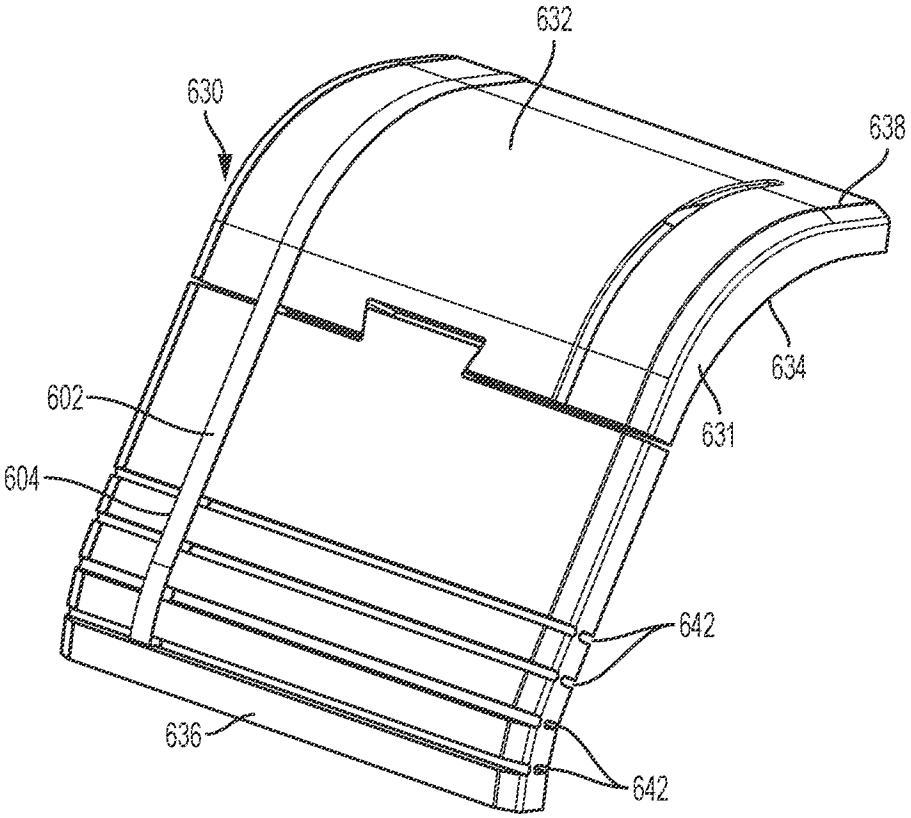
FIG. 15 is a perspective view of a wear pad having an insert according to an embodiment described herein.

FIG. 15 is a perspective view of a wear pad 630, formed generally as a body 631 having a groove 604 with the insert 602 disposed therein, according to an embodiment described herein. The body 631 may be a single piece, or may be comprised on a plurality of segments 636, 638. In one embodiment, the wear pad 630 may be substantially rigid and preformed to have a size and shape to fit a particular telescoping boom section. Further, in one embodiment, one or more segments 636, 638 of the wear pad 630 may include one or more recesses 642, similar to the recesses described in the embodiments above with reference to FIGS. 1-11, allowing for flexibility in fitting around a telescoping boom section.

In the embodiment shown in FIG. 15, the groove 604 is disposed on an outer or convex surface 632 of the wear pad 630. However, as detailed above, the present disclosure is not limited to such a configuration, and in other embodiments, the groove 604 and insert 602 may be disposed at an inner surface 634 of the wear pad 630.

Figure 16:
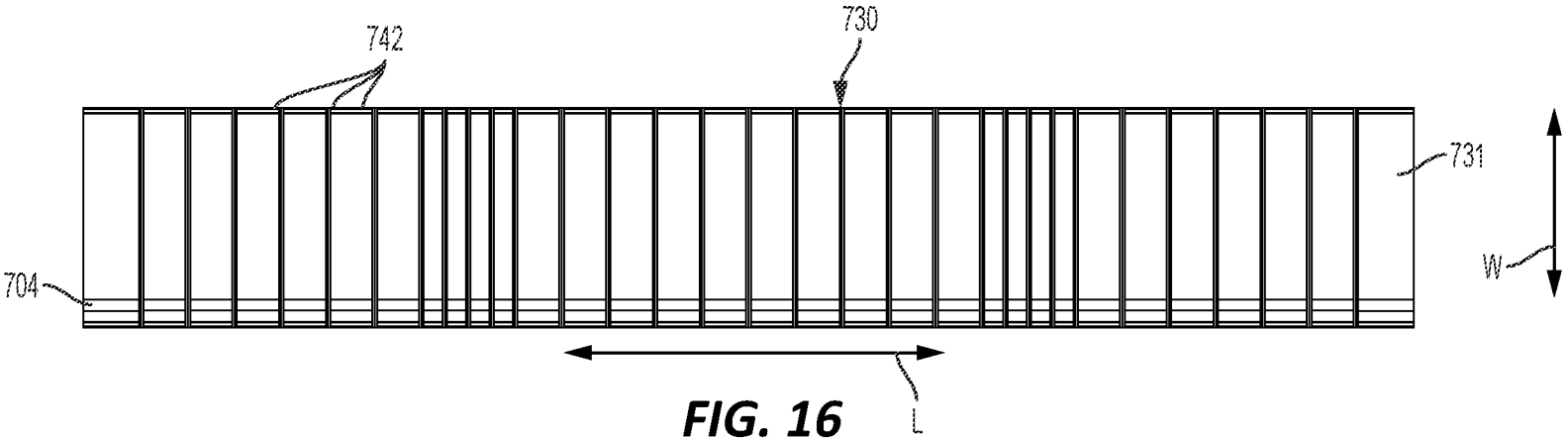
FIG. 16 is a plan view of a wear pad configured for use with an insert according to an embodiment described herein.

FIGS. 16-20 are different views of an example of another wear pad 730 configured for use with the insert 602. Referring to FIG. 16, the wear pad 730 may be a shape-compliant wear pad formed as a body 731 of material that includes a plurality of recesses 742 extending across its width, to allow for flexibility in fitting around a telescoping boom section. The "width" direction W of the wear pad 730 referred to above corresponds to an axial or longitudinal direction of a telescoping boom in which the wear pad 730 is installed. The wear pad 730 includes a groove 704 configured to receive and/or retain the insert 602 (shown in FIGS. 12-14). The groove 704 extends generally in a length direction L of the wear pad 730, which corresponds to a peripheral or circumferential direction of a telescoping boom segment around which the wear pad 730 is installed.

In one embodiment, the groove 704 extends substantially perpendicular to a plurality of recesses 742 formed in the wear pad 730.

Figure 17:
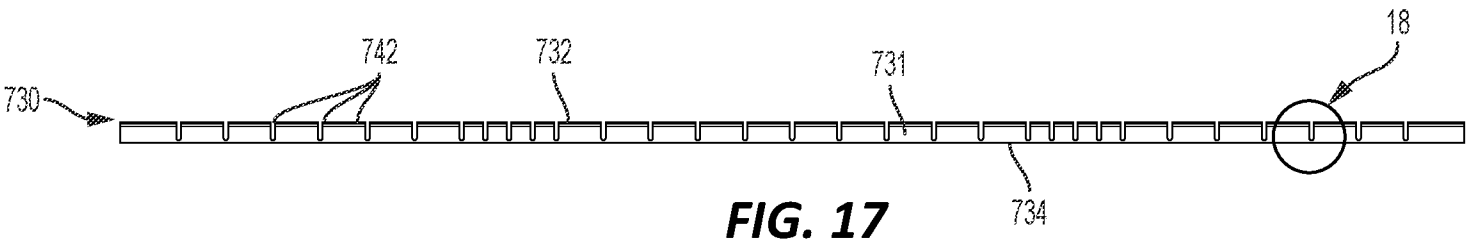
FIG. 17 is a side view of the wear pad of FIG. 16.
Figure 19:
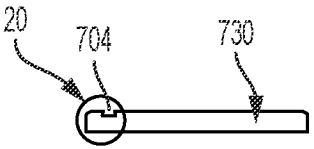
FIG. 19 is an end view of the wear pad of FIG. 16.
Figure 20:
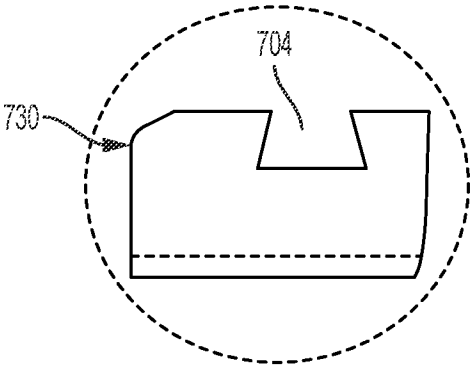
FIG. 20 is an enlarged view of a portion of the wear pad of FIG. 19.
Figure 18:
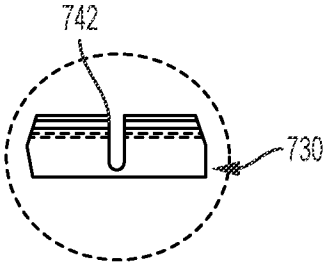
FIG. 18 is an enlarged view of a portion of the wear pad of FIG. 17.

FIG. 17 is a side view of the wear pad 730 of FIG. 16 and FIG. 18 is an enlarged view of a portion (identified at reference number 18) of the wear pad 730 of FIG. 17, according to one embodiment. FIG. 19 is an end view of the wear pad 730 showing a cross-sectional shape of the groove 704 and FIG. 20 is an enlarged view of a portion (identified at reference number 20) of the wear pad 730 of FIG. 19, according to one embodiment. Referring to FIGS. 17 and 18, in one embodiment, the recesses 742 may be formed in only one of a first surface 732 and a second surface 734.

With reference to FIGS. 19 and 20, the groove 704 is shown having a substantially trapezoidal cross-sectional shape, similar to the embodiments detailed above. Likewise, the insert 602 may be formed having a corresponding substantially trapezoidal shape, as shown in FIG. 12, for example. However, as detailed above, the insert 602 may have a height that is greater than a depth of the groove 704, so that the insert 602 projects outwardly from the wear pad 730 beyond one of the first and second surfaces 732, 734. In addition, as detailed above, the groove 742 and insert 602 are not limited to the substantially trapezoidal shapes shown in the figures.

Referring to FIGS. 16-20, in one embodiment, the groove 704 for the insert 602 is formed on the same surface of the wear pad 730 as the recesses 742. Thus, the groove 704 may intersect the recesses 742 of the wear pad 730. In one embodiment, this surface (i.e., the surface with the groove 704 and recesses 742) may correspond to an outer or convex surface (the first surface 732 in FIGS. 16-20) of the wear pad 730 when installed in a telescoping boom. However, as detailed above, the present disclosure is not limited to such a configuration, and the groove 704, along with the insert 602 retained therein, and/or the recess 742 may be formed on an inner or concave side of the wear pad 730 to retain the insert 602 on the inner surface (the second surface 734 in FIGS. 16-20). In another embodiment, the groove 704 may be formed on a surface of the wear pad 730 opposite from the plurality of recesses 742.

FIGS. 21-30 are different views of another embodiment of a wear pad 830 configured for use with the insert 602. In this embodiment, the wear pad 830 includes a body 831 and may be substantially rigid and machined as a preformed part configured to be installed on a particular telescoping boom segment. The wear pad 830 may include multiple segments that may be secured together, or installed individually in the telescoping boom.

Figure 24:
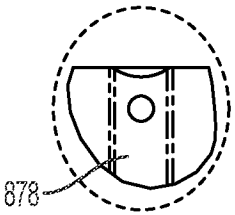
FIG. 24 is an enlarged view of a portion of the wear pad of FIG. 23.
Figure 23:
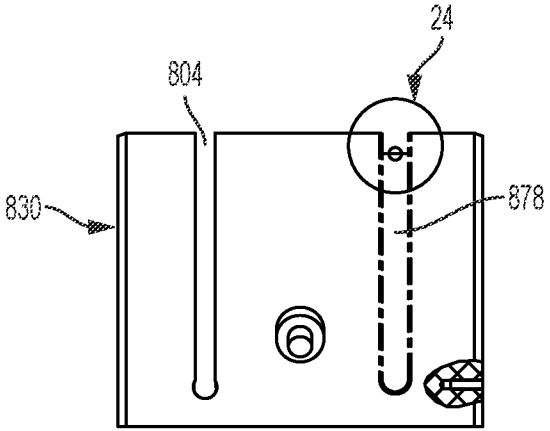
FIG. 23 is an outer view of the wear pad of FIG. 21.
Figure 22:
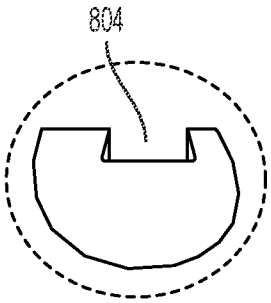
FIG. 22 is an enlarged view of a portion of the wear pad of FIG. 21.
Figure 21:
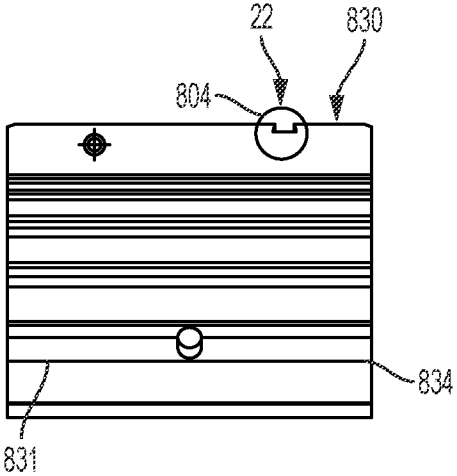
FIG. 21 is an inner view of a wear pad configured for use with an insert according to an embodiment described herein.
Figure 25:
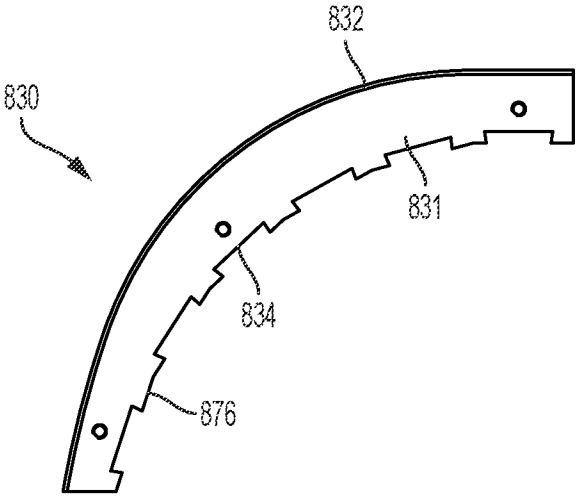
FIG. 25 is an axial view of the wear pad of FIG. 21.
Figure 26:
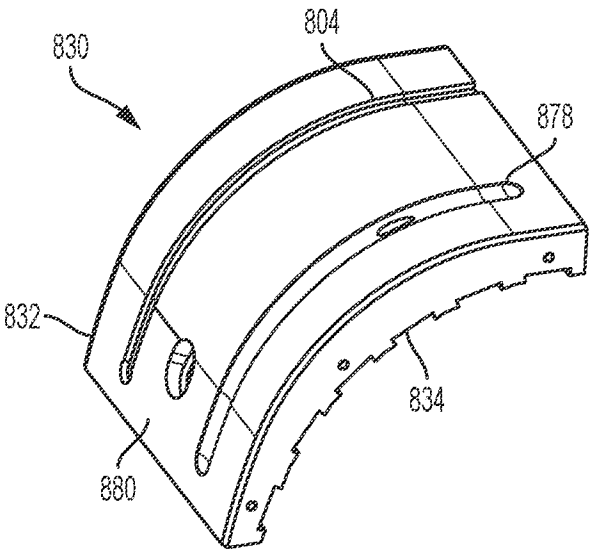
FIG. 26 is a perspective view of the wear pad of FIG. 21.

FIG. 21 is a side view showing an inner surface 834 and end view of a top portion of the wear pad 830, according to one embodiment. FIG. 22 is an enlarged view showing a portion (identified at reference number 22) of the wear pad 830 having a groove 804 for receiving and/or retaining the insert 602 (see FIGS. 12-14). FIG. 23 shows an outer surface 832 of the wear pad 830 according to one embodiment, and FIG. 24 is an enlarged view showing a portion (identified at reference number 24) of the outer surface 832. FIG. 25 is an axial view (relative to a telescoping boom) of the wear pad 830, according to one embodiment. FIG. 26 is a perspective view of the wear pad 830 according to an embodiment described herein.

Referring to FIGS. 21-26, the groove 804 for receiving and/or retaining the insert 602 is formed on the outer or convex surface (i.e., the first surface 832) of the wear pad 830. An inner surface (i.e., the second surface 834) of the wear pad 830 may include one or more feet 876 (FIG. 25) configured to engage an outer surface of an inner telescoping boom section. In one embodiment, the outer surface 832 may additionally be formed with a channel 878 configured retain grease or other similar lubricant.

Figure 27:
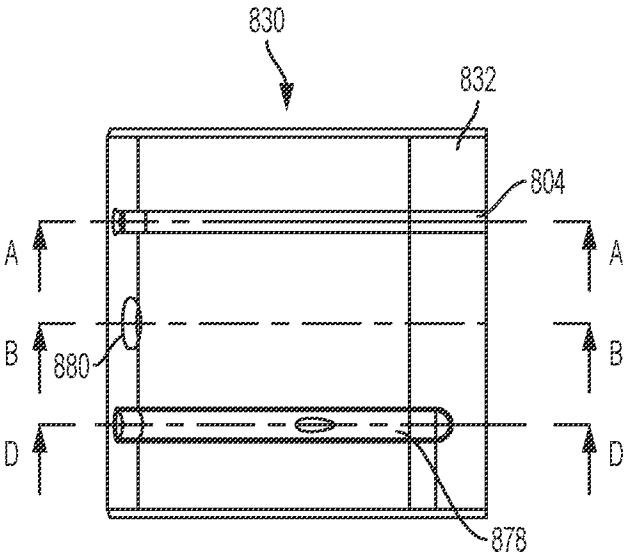
FIG. 27 is another outer view of the wear pad of FIG. 21.
Figure 30:
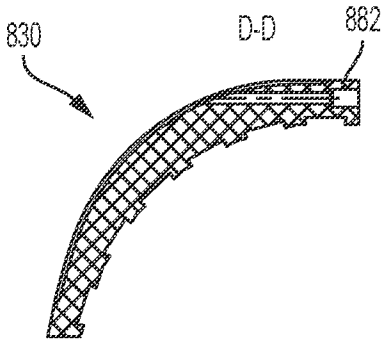
FIG. 30 is a cross-sectional view taken at C-C of FIG. 27.
Figure 29:
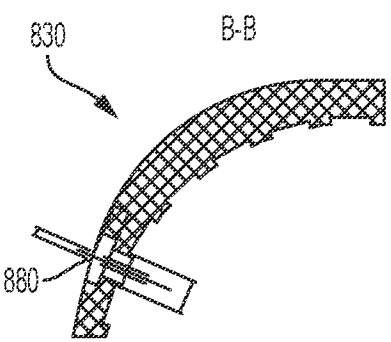
FIG. 29 is a cross-sectional view taken at B-B of FIG. 27.
Figure 28:
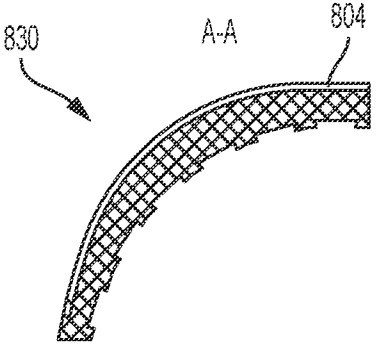
FIG. 28 is a cross-sectional view taken at A-A of FIG. 27.

FIG. 27 is another view of the outer surface 832 of the wear pad 830. FIGS. 28-30 are cross-sectional views taken at different locations in FIG. 27. Referring to FIGS. 21-30, the wear pad 830 may be formed with one or more fastener openings 880 configured to receive fasteners for securing the wear pad 880 to a telescoping boom segment. Additionally, the channel 878 may be connected to a feed 882 through which the grease or other lubricant may be supplied to the channel 880.

With further reference to FIGS. 21-30, the groove 804 is shown having a substantially trapezoidal cross-sectional shape, similar to the embodiments detailed above. Likewise, the insert 602 may be formed having a corresponding substantially trapezoidal shape, as shown in FIG. 12, for example. However, as detailed above, the insert 602 projects outwardly from the wear pad 830. In addition, as detailed above, the groove 804 and insert 602 are not limited to the substantially trapezoidal shapes shown in the figures. Further, in FIGS. 21-30, groove 804 is shown on an outer or convex surface 832 of the wear pad 830 when installed in the telescoping boom. However, as detailed above, the present disclosure is not limited to such a configuration, and the groove 804 may be formed on an inner or concave side of wear pad 830 to retain the insert 602 on the inner side.

Figure 32:
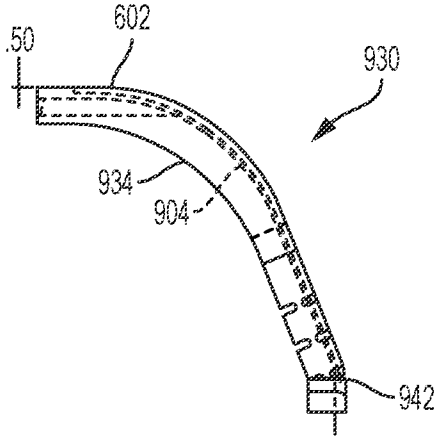
FIG. 32 is an axial view of the wear pad of FIG. 31.
Figure 31:
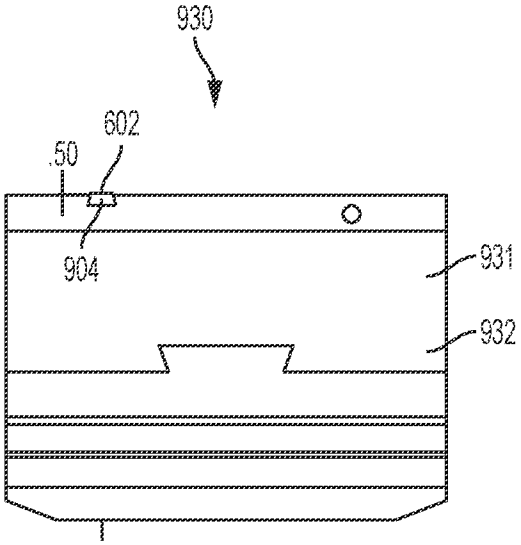
FIG. 31 is an inner view of a wear pad together with an insert according to an embodiment described herein.

FIGS. 31 and 32 show and embodiment of a wear pad 930 comprising a body 931 having the insert 602 installed in the groove 904. Referring to FIG. 31, the insert 602 may extend outwardly from groove 904 so as to project from the wear pad 930. Accordingly, the insert 602 is configured to contact a surface of an immediately adjacent telescoping boom section (e.g., the first section 20 or the second section 25) during telescoping movement of the boom sections. Similarly, FIG. 32 shows the insert 602 extending outwardly from the groove 904. Similar to some of the embodiments described above, the wear pad 930 may include a plurality of recesses 942 to allow for flexibility and compliance around at least a portion of a boom section.

With further reference to FIGS. 31 and 32, the groove 904 is shown having a substantially trapezoidal cross-sectional shape, similar to the embodiments detailed above. Likewise, the insert 602 may be formed having a corresponding substantially trapezoidal shape, as shown in FIG. 12, for example. However, as detailed above, the groove 904 and the insert 602 are not limited to the substantially trapezoidal shapes shown in the figures. Further, in FIGS. 31-32, the groove 904 is shown on an outer or convex surface (i.e., first surface 932) of the wear pad 930. However, as detailed above, the present disclosure is not limited to such a configuration, and the groove 904 may be formed on an inner or concave surface (i.e., second surface 934) of the wear pad 930 to retain the insert 602 on the inner surface.

Figure 33:
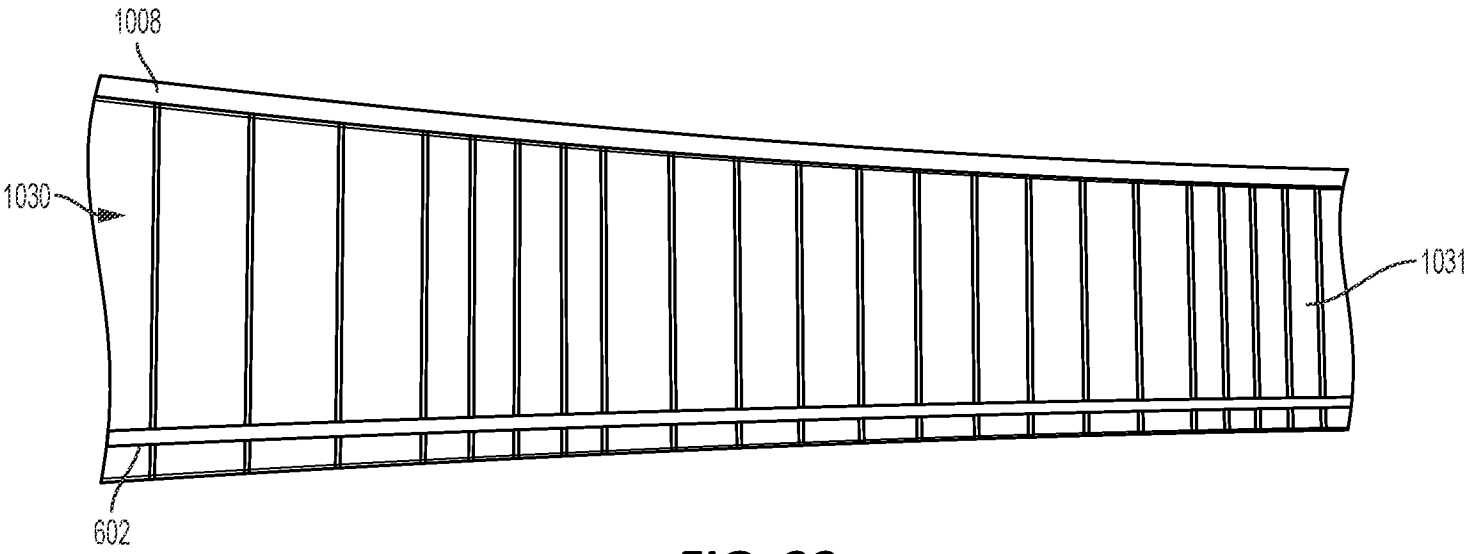
FIG. 33 is a plan view of a wear pad according to another embodiment described herein.
Figure 34:
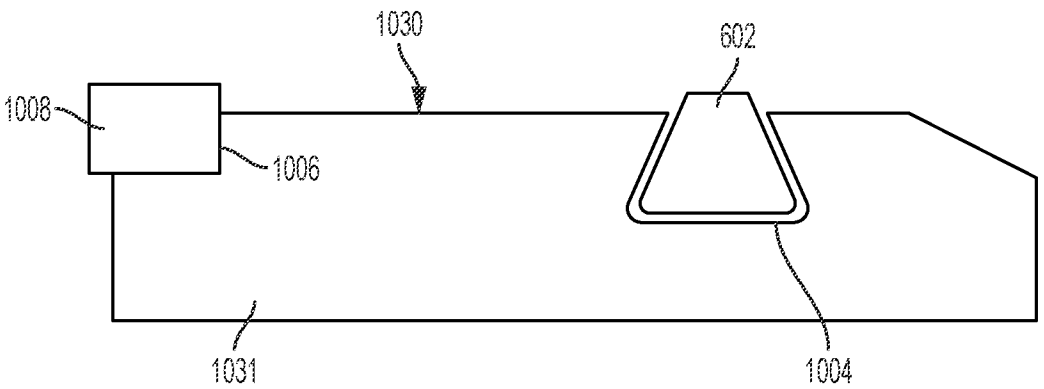
FIG. 34 is a side view of the wear pad of FIG. 33.

FIGS. 33 and 34 show another embodiment of a wear pad 1030 comprising a body 1031 together with the insert 602 in a groove 1004. In one embodiment, the wear pad 1030 may optionally include a second groove 1006 extending generally in a length direction of the wear pad 1030 (which corresponds to the peripheral or circumferential direction of a telescoping boom section). A wiper 1008 may be disposed in the second groove 1006. The wiper 1008 may be, for example a strip of felt material or a fabric covered insert. The wiper 1008 is configured to contact an immediately adjacent boom section and wipe debris, such as dirt, lubricant, or other particles from a surface of the adjacent boom section during telescoping movement. Similar to the insert 602 and groove 1004, the wiper 1008 and second groove 1006 may be disposed at either an inner surface or an outer surface of the wear pad 1030 to contact the immediately adjacent telescoping boom surface during telescoping movement.

In the embodiments above, the wear pads are configured for use in combination with a telescoping boom of a construction vehicle, such as a crane. In one embodiment, a single wear pad may be used. In another embodiment, a first wear pad may be installed at a rear or proximal end of an inner telescoping section, with the insert 602 disposed on an outer facing surface of the wear pad, and a second wear pad may be disposed at a front or distal end of an outer telescoping section, with the insert 602 disposed on an inner facing surface of the second wear pad. The first wear pad may be fixed relative to the inner telescoping section, and slidable relative to the outer telescoping section, with telescoping movement of the inner telescoping section. The second wear pad may be fixed relative to the outer telescoping section, and the inner telescoping section may slide relative to the second wear pad and the outer telescoping section. In another configuration, the wear pad may be installed at the rear or proximal end of the inner telescoping boom section, with the insert 602 disposed on the outer surface of the wear pad, and another wear pad, including conventional wear pads, may be disposed at the front or distal end of the outer telescoping boom section. Various combinations of these arrangements are envisioned as well.

Accordingly, in the embodiments above, the insert 602 may extend outwardly beyond an outer surface of a wear pad to contact an inner surface of an immediately adjacent outer telescoping boom section. The insert 602 may then provide relatively low friction contact between the inner telescoping boom section and outer telescoping boom section to allow for relatively smooth telescoping movement of the inner boom section relative to the outer boom section, and rough movement and chattering may be substantially reduced or prevented. In another configuration, the insert 602 may extend inwardly beyond an inner surface of the wear pad to contact an outer surface of an immediately adjacent inner telescoping boom section. Accordingly, the insert 602 may then provide relatively low friction contact between the outer telescoping boom section and the inner telescoping boom section to allow for relatively smooth telescoping movement. Because the insert 602 is made of a relatively low friction material, use of fluid or semi-solid lubricants may be reduced or eliminated, leading to easier and cleaner service and maintenance of the telescoping boom.

Further, in the embodiments above, the insert 602 may extend completely or substantially completely along the length of the wear pad. In some embodiments, the insert 602 extends continuously along the length of wear pad. Accordingly, the insert 602 may contact the immediately adjacent telescoping boom section surface to provide a large low-friction contact surface. Such a configuration may be useful to reduce or eliminate the need for additional lubricants, such as grease.

It is understood the various features from any of the embodiments above are usable together with the other embodiments described herein. For example, the wear pads shown and described with reference to FIGS. 2-11 may include a groove configured to receive and/or retain the insert 602 as shown and described, for example, with reference to FIGS. 12-34. Further, it is understood that same or similar terminology used across the different embodiments above refers to the same or similar component, with the exception of any differences described or shown in the figures.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A wear pad for a telescoping boom assembly comprising:

a wear pad body having a first surface and a second surface oppositely positioned from the first surface and spaced from the first surface by a height of the wear pad body;

a plurality of recesses formed in at least one of the first surface and the second surface and extending in a width direction of the wear pad body, the recesses spaced apart along a length of the wear pad body;

a groove formed in one of the first surface and the second surface, the groove extending along the length of the wear pad body, wherein the groove includes an open side elongated along the length of the wear pad body; and an insert positioned in the groove such that a portion of the insert projects outwardly from the open side of the groove, wherein the wear pad is configured to be installed between an inner telescoping boom section and an immediately adjacent outer telescoping boom section.

2. The wear pad of claim 1, wherein the insert is a low friction material.

3. The wear pad of claim 2, wherein the low friction material includes at least one of: polytetrafluoethylene, graphite, and molybednum disulfide.

4. The wear pad of claim 1, wherein the groove and the insert at least partially correspond in shape such that the insert is retained in the groove by way of an interlocking fit.

5. The wear pad of claim 1, wherein the plurality of recesses allow for flexing of the wear pad body.

6. The wear pad of claim 5, wherein the wear pad body is movable from a substantially flat un-flexed condition to a flexed condition having at least one radius of curvature.

7. The wear pad of claim 1, wherein the wear pad body is machined in a preformed shape and size, having a radius of curvature, and is substantially rigid.

8. The wear pad of claim 1, wherein the insert and groove are disposed on the first surface of the wear pad body, the first surface being an outer surface of the wear pad body having a generally convex shape.

9. The wear pad of claim 1, wherein the insert and groove are disposed on the second surface of the wear pad body, the second surface being an inner surface of the wear pad body and having a generally concave shape.

10. The wear pad of claim 1, further comprising a second groove and a wiper disposed in the second groove.

11. A telescoping boom assembly, comprising:

an outer boom section;

an inner boom section disposed in the outer boom section and configured for telescoping movement to extend out of and retract into the outer boom section;

a wear pad having a first surface and a second surface oppositely positioned from the first surface and spaced from the first surface by a height of the wear pad;

a plurality of recesses formed in at least one of the first surface and the second surface and extending in a width direction of the wear pad, the recesses spaced apart along a length of the wear pad;

a groove formed in one of the first surface and the second surface, the groove extending along the length of the wear pad; and an insert positioned in the groove, the insert having a portion which projects outwardly from the open side of the groove, wherein the wear pad is installed at one of the inner boom section and the outer boom section and the insert is configured to contact the other of the inner boom section and the outer boom section.

12. The telescoping boom assembly of claim 11, wherein the insert is a low friction material.

13. The telescoping boom assembly of claim 12, wherein the low friction material includes at least one of: polytetrafluoethylene, graphite, and molybednum disulfide.

14. The telescoping boom assembly of claim 11, wherein the groove and the insert at least partially correspond in shape such that the insert is retained in the groove by way of an interlocking fit.

15. The telescoping boom assembly of claim 11, wherein the wear pad is installed on the inner boom section.

16. The telescoping boom assembly of claim 15, wherein the insert and groove are disposed on the first surface of the wear pad, the first surface being an outer surface having a generally convex shape, such that the insert contacts an inner surface of the outer boom section.

17. The telescoping boom assembly of claim 11, the wear pad further comprising a second groove and a wiper disposed in the second groove.

18. A telescoping boom assembly of a crane, comprising:

an outer boom section;

an inner boom section disposed in the outer boom section and configured for telescoping movement to extend out of and retract into the outer boom section;

a first wear pad having a first surface and a second surface oppositely positioned from the first surface and spaced from the first surface by a height of the first wear pad;

a plurality of recesses formed in at least one of the first surface and the second surface and extending in a width direction of the first wear pad, the recesses spaced apart along a length of the first wear pad;

a groove formed in one of the first surface and the second surface, the groove extending along the length of the first wear pad, the groove having a depth and an open side elongated along the length of the first wear pad;

an insert positioned in the groove, the insert having a height greater than the depth of the groove such that a portion of the insert projects outwardly from the open side of the groove; and a second wear pad, wherein the first wear pad is installed at a rear portion of the inner boom section and is configured to move with the inner boom section relative to the outer boom section, and the second wear pad is installed at a forward portion of the outer boom section and is fixed relative to the outer boom section.

19. The telescoping boom assembly of claim 18, wherein an inner surface of the second wear pad is configured to contact an outer surface of the inner boom section.

20. The telescoping boom assembly of claim 18, wherein the second wear pad includes a groove formed in an inner surface extending along a length of the second wear pad, and an insert positioned in the groove having a portion projecting outwardly from the groove.

* * * * *